US008252497B2

(12) United States Patent
Yamazaki et al.

(10) Patent No.: US 8,252,497 B2
(45) Date of Patent: Aug. 28, 2012

(54) TONER, TONER PRODUCTION METHOD, AND IMAGE FORMING DEVICE USING THE SAME

(75) Inventors: Soichi Yamazaki, Shiojiri (JP); Takatomo Fukumoto, Shiojiri (JP); Hideki Okada, Shiojiri (JP); Toshikazu Ono, Tatsuno-machi (JP)

(73) Assignee: Seiko Epson Corporation, Tokyo (JP)

( * ) Notice: Subject to any disclaimer, the term of this patent is extended or adjusted under 35 U.S.C. 154(b) by 240 days.

(21) Appl. No.: 12/758,644

(22) Filed: Apr. 12, 2010

(65) Prior Publication Data

US 2010/0261110 A1 Oct. 14, 2010

(30) Foreign Application Priority Data

Apr. 13, 2009 (JP) ..... 2009-096811

(51) Int. Cl.
*G03G 9/08* (2006.01)

(52) U.S. Cl. ..... 430/110.4; 430/108.1; 430/110.1; 430/137.1; 399/252

(58) Field of Classification Search ..... 430/110.4, 430/108.1, 110.1, 137.1; 399/252
See application file for complete search history.

(56) References Cited

U.S. PATENT DOCUMENTS

| | | | | |
|---|---|---|---|---|
| 6,013,402 | A | 1/2000 | Kanbayashi et al. | |
| 2005/0079429 | A1 * | 4/2005 | Hayami et al. | 430/45 |
| 2009/0011357 | A1 | 1/2009 | Kawase et al. | |

FOREIGN PATENT DOCUMENTS

| | | |
|---|---|---|
| JP | 58-026029 | 2/1983 |
| JP | 63-100017 | 5/1988 |
| JP | 08-211657 | 8/1996 |
| JP | 11-237766 | 8/1999 |
| JP | 2002-028527 | 1/2002 |
| JP | 2002-253953 | 9/2002 |
| JP | 2004-133326 | 4/2004 |
| JP | 2009-015175 | 1/2009 |

* cited by examiner

*Primary Examiner* — Mark A Chapman
(74) *Attorney, Agent, or Firm* — Workman Nydegger

(57) ABSTRACT

A toner, has a number mode diameter of 3 μm or more and 6 μm or lower and a particle size distribution of a toner including an externally-applied agent in the range of 0.6 μm to 400 μm in which the number frequency of a toner smaller than the number mode diameter is smaller than the number frequency of a toner equal to or larger than the number mode diameter.

11 Claims, 5 Drawing Sheets

TONER, TONER PRODUCTION METHOD, AND IMAGE FORMING DEVICE USING THE SAME

CROSS-REFERENCE TO A RELATED APPLICATION

The entire disclosure of Japanese Patent Application No. 2009-096811, filed Apr. 13, 2009 is expressly incorporated by reference herein.

BACKGROUND

1. Technical Field

The present invention relates to an electrostatic latent image developing toner for developing electrostatic latent images on a latent image support in image output devices, such as copying machines, printers, or faxes, a toner production method, and an image forming device using the same.

2. Related Art

In image output devices, such as electrophotographic copying machines, printers, and faxes, the diameter of toner particles for use in image formation has been increasingly reduced in order to meet demands of increasing the resolution of printed image, increasing the gradation thereof, reducing the amount of waste toners, reducing the consumption energy by lowering fixing temperatures, etc.

However, a small-diameter particle toner is likely to scatter, which causes problems of scattering of the toner into image forming devices and occurrence of toner stain, and further it has become an object to prevent the toner from scattering into the air from the devices. Heretofore, techniques for suppressing toner scattering have been developed. With a reduction in a toner particle size, the importance of suppressing toner scattering has further increased.

The toner has two kinds of adhesive force, i.e., static electricity force in which the electric field can be controlled and van der Waals force in which the electric field cannot be controlled. A reduction in the toner particle size increases the ratio of the van der Waals force relative to the ratio of the static electricity force, and thus it has become difficult to control the toner by the electric field. Moreover, a reduction in the toner particle size increases air resistance relative to gravity sedimentation. Therefore, when the toner that cannot be controlled by the electric field scatters during development or the like, the toner is likely to scatter in the air outside devices while being carried by the air current from a cooling fan or the like of devices.

In contrast, concerns on influences of floating particulates in the air, particularly fine particles, on the health have increased. It is mentioned that the standard on fine particles having a diameter of 2.5 μm or lower causing diseases of respiratory organs or the like, which is referred to as PM2.5, has been added in the U.S. environmental standards or the WHO guideline. Also in Japan, considering that the discussion on the establishment of environmental standards is being advanced, it is significant to prevent toners having a particle size of 2.5 μm or lower from scattering in the air.

In order to separate particles having a specific particle size from the toner, it has been proposed to classify powder containing 50% by number or more of particles having a volume average particle size of 7 μm or lower by transporting a toner to a vertical cylindrical pot, allowing the pot to stand still for 2 hours, performing separation by sedimentation, and then opening a stopping valve of a nozzle disposed at the pot side surface to discharge 50% of the whole amount of the resultant as a supernatant liquid (e.g., JP-A-2002-28527). However, the method requires long time for standing still and sedimentation, and thus has posed problems in industrially producing a toner.

It has also been proposed to prepare a toner having a volume average particle size of 6 to 8 μm by applying a centrifuge force of 1000 to 3000G using a decanter type centrifuge having two functions of separation by sedimentation and filtration drying (e.g., JP-A-2004-133326).

According to the method, a toner having an average particle size of 6.5 μm is obtained, but a toner of 3 μm or lower is contained in a proportion as high as 6%, and thus the toner does not sufficiently meet the standard of PM2.5.

According to former toner classifying methods, it is required to allow a toner to stand still for a long time and the content of a toner having a particle size distribution of 3 μm or lower decreases before classification, but the reduction degree of the toner having a particle size of 3 μm or lower has not been sufficient.

SUMMARY

An advantage of some aspects of the invention is to provide a toner not containing fine particles. In particular, an advantage of some aspects of the invention is to provide a method for efficiently producing a toner in which a toner having a particle size of 2.5 μm or lower is removed and the particle size becomes uniform. An advantage of some aspects of the invention is to provide a toner in which scattering of fine externally-applied agents to be added to the toner in the air is prevented and an image forming device using the toner.

According to a first aspect of the invention, a toner has a number mode diameter of 3 μm or more and 6 μm or lower and a particle size distribution of a toner including an externally-applied agent in the range of 0.6 μm to 400 μm, in which the number frequency of a toner smaller than the number mode diameter is smaller than the number frequency of a toner equal to or larger than the number mode diameter.

Thus, by specifying the size relationship of the frequencies of particles around the number mode diameter and further specifying the number mode diameter in a specific range, a toner in which the amount of fine particles is extremely reduced and the frequency of 2.5 μm or lower is low can be provided.

It is preferable that the toner pass through a process for classifying fine particles in liquid and have the number frequency of 2.5 μm or lower of 5% or lower.

By precisely classifying particles in liquid, a toner can be provided in which the content of a fine-powder toner having a particle sizes of 2.5 μm or lower is small.

It is preferable that the toner contain 0.05 to 2 parts by mass of silicone oil based on 100 parts by mass of colored resin particles.

The blending of the silicone oil allows further suppressing scattering of the fine-powder toner without exerting adverse effects on image quality.

It is preferable that that toner contain, as an externally-applied agent, alumina fine particles having a phase angle (θ) in an alternating frequency range of 1 kHz to 10 kHz measured by an alternating impedance method of |80°| or lower.

Thus, since the toner contains, as an externally-applied agent, the alumina fine particles in which the phase angle (θ) in an alternating frequency range of 1 kHz to 10 kHz measured by an alternating impedance method is |80°| or lower, scattering from a development gap or fogging can be suppressed even when jumping development is performed. Thus, the toner of the invention is preferable.

According to a second aspect of the invention, a toner production method includes: pouring a dispersion liquid in which colored resin particles are dispersed in an aqueous medium in a centrifuge having a nonporous cylindrical tank on the inner wall surface having a rotation axis in the perpendicular direction and rotating the centrifuge, discharging the dispersion liquid in the cylindrical tank after particle components adhere to the inner wall surface of the cylindrical tank by centrifuge force, and separating the colored resin particles adhering to the inner wall surface, thereby obtaining a toner having a number mode diameter of 3 μm or more and 6 μm or lower and having a particle size distribution of a toner including an externally-applied agent in the range of 0.6 μm to 400 μm in which the number frequency of a toner smaller than the number mode diameter is smaller than the number frequency of a toner equal to or larger than the number mode diameter.

In the toner of the invention, when centrifuge force is applied to the dispersion liquid containing colored resin particles by rotating the cylindrical tank having a nonporous wall surface as described above, the colored resin particles adhere to the wall surface of the cylindrical tank in the shape of a cake by the action of the centrifuge force but many of particles having a small particle size remain in the dispersion liquid and also washed away from the cake-like adhered substance by the dispersion liquid and discharged. Thus, a toner in which the content of fine powder particles of 2.5 μm or lower is small can be provided.

It is preferable that, in the toner production method, the centrifuge force be 500 to 900 G and the rotation time be 5 to 30 minutes.

Thus, the centrifuge force given to a dispersion liquid by the method of the invention is smaller than the centrifuge force applied during former wet classification and the application time of the centrifuge force is also short. Therefore, a relatively large cavity is formed in a deposition layer of particles compared with the case where a high centrifuge force is given for a long time, and fine powder particles having a small particle size are removed together with the discharge liquid when the remaining dispersion liquid is discharged. Thus, a toner in which the content of the fine powder particles of 2.5 μm or lower is small can be produced.

According to a third aspect, a toner production method includes separating the dispersion liquid of the cylindrical tank, dispersing colored resin particles adhering to the inner wall surface in an aqueous medium, pouring the same in the centrifuge, and repeating the process described above.

Thus, by dispersing the dispersion liquid and the separated cake-like deposited substance in an aqueous medium, pouring the same again in the cylindrical tank, and repeating the process described above, a toner in which the content of a fine powder toner of 2.5 μm or lower is small can be produced.

It is preferable that, in the toner production method, the colored resin particles be produced by unifying particles deposited by emulsifying a composition at least containing a synthetic resin and a coloring agent in an aqueous medium by adding an electrolyte.

The toner production method of the invention is preferable as a method for separating fine powder particles from a toner having a small particle size obtained by unifying particles deposited by emulsifying a composition at least containing a synthetic resin, a coloring agent, and a wax in an aqueous medium by adding an electrolyte.

According to a fourth aspect of the invention, an image forming device has a photoreceptor supporting an electrostatic latent image and a development device that is disposed facing the photoreceptor in a non-contact state with the photoreceptor and that develops the electrostatic latent image on the photoreceptor by jumping development of adhering a toner to the electrostatic latent image on an electrostatic latent image support by flying the toner between a development member and the electrostatic latent image support that are held in a non-contact state using a toner obtained by pouring a dispersion liquid in which colored resin particles are dispersed in an aqueous medium in a centrifuge having a nonporous cylindrical tank on the inner wall surface having a rotation axis in the perpendicular direction and rotating the centrifuge, stopping the rotation of the cylindrical tank after particle components adhere to the inner wall surface of the cylindrical tank by centrifuge force, classifying the particles by discharging the dispersion liquid in which the proportion of particles having a small particle size in the cylindrical tank increases, and then drying the colored resin particles adhering to the inner wall surface of the cylindrical tank and having a number mode diameter of 3 μm or more and 6 μm or lower and a particle size distribution of a toner including an externally-applied agent in the range of 0.6 μm to 400 μm in which the number frequency of a toner smaller than the number mode diameter is smaller than the number frequency of a toner equal to or larger than the number mode diameter.

Thus, an image forming device capable of forming excellent quality images while suppressing scattering of a toner in the surrounding environment can be provided.

BRIEF DESCRIPTION OF THE DRAWINGS

The invention will be described with reference to the accompanying drawings, wherein like numbers reference like elements.

FIG. 2A is a view illustrating a rotation state. FIG. 2A is a cross sectional view.

FIG. 2B is a view illustrating that the rotation is stopped. FIG. 2B is a cross sectional view.

FIG. 2C is a view illustrating that a remaining dispersion liquid is removed. FIG. 2C is a cross sectional view.

FIG. 4A is an enlarged view of an image formation unit illustrated in FIG. 2.

FIG. 4B is a view illustrating a development process.

FIG. 5A is a side view thereof.

FIG. 5B is a cross sectional view in which one end of a development roll is enlarged.

DESCRIPTION OF EXEMPLARY EMBODIMENTS

The invention provides a toner in which scattering of fine powder particles from an image forming device is suppressed although the toner is a small particle size toner and an image forming device using the same by classifying the toner in liquid. The invention provides a toner in which the generation of fine particles of 2.5 μm or lower that are considered to cause diseases of respiratory organs and the like is particularly suppressed and an image forming device using the same.

In the invention, by classifying fine particles of 2.5 μm or lower with high precision, the number frequency of particles equal to or lower than the mode (model) diameter is adjusted to be equal to or lower than the number frequency of particles equal to or higher than the mode diameter. Even in the case of a toner to which an externally-applied agent is added, the invention can be achieved by classifying fine particles of 2.5 μm or lower with high precision so that the relationship of the number frequency of particles equal to or lower than the mode (model) diameter ≦ the number frequency of particles to or higher than the mode diameter can be maintained.

Figure 1A:
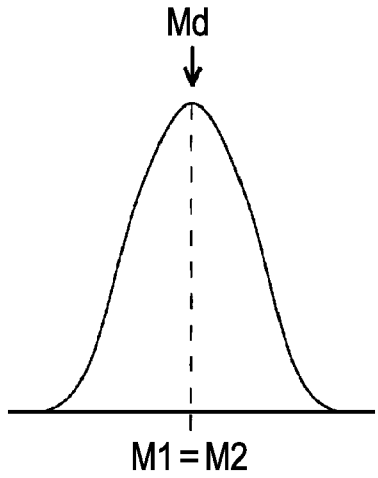
FIGS. 1A-1C are views illustrating a particle size distribution of a toner of the invention.
Figure 1B:
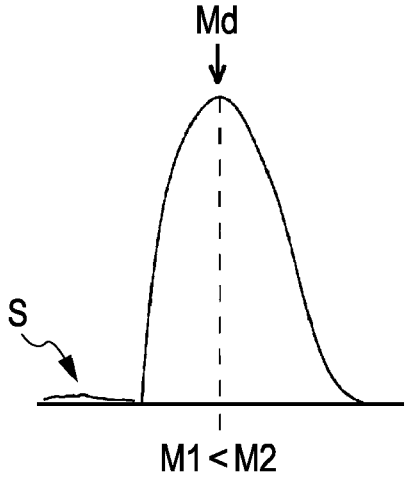
Figure 1C:
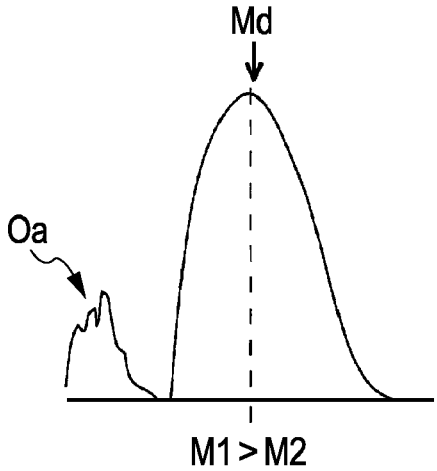

FIG. 1 is a view illustrating the particle size distribution of the toner of the invention.

FIG. 1 is a view in which the frequency is plotted on the axis of ordinates and the particle size is plotted on the axis of abscissa and the frequency distribution of the particle size is illustrated together with the mode diameter Md which is the model diameter.

FIG. 1(A) is a view illustrating the case where the particle size distribution is a normal distribution, in which the frequency M1 of particles having a diameter equal to or lower than the mode diameter and the frequency M2 of particles having a diameter equal to or higher than the mode diameter are present around the mode diameter Md.

In contrast, FIG. 1(B) illustrates the toner of the invention in which the frequency M1 of particles having a particle size smaller than the mode diameter Md is made lower than the frequency M2 of particles having a particle size larger than the mode diameter Md by extremely reducing the amount of fine powder S.

Thus, when the frequency of the particles of 2.5 μm or lower is lowered, the frequency of particles having a particle size smaller than the mode diameter Md can be made smaller than the frequency of particles having a particle size equal to or larger than the mode diameter.

Furthermore, fine powder particles are separated from the toner of the invention. Thus, also when a fine powder externally-applied agent Oa is added to the classified particles for flow improvement properties or the like, the frequency M1 equal to or lower than the mode diameter can be prevented from becoming larger than the frequency M2 equal to or higher than the mode diameter.

As a result, a toner and an image forming device that do not cause a problem of scattering of a fine powder toner can be provided.

In the toner and the toner production method of the invention, a toner is preferable in which colored resin particles are produced by unifying particles deposited by emulsifying a composition containing a synthetic resin and a coloring agent in an aqueous medium by adding an electrolyte.

The method for producing such a toner will be described below in order of the respective processes.

The toner production method includes:

First process: Process for forming fine particles by emulsifying a resin solution containing a polyester resin and an organic solvent as essential components in an aqueous medium, Second process: Process for unifying the fine particles to produce an aggregate, Third process: Process for removing an organic solvent contained in the aggregate, Fourth process: Process for classifying and separating particles from an aqueous medium, and Fifth process: Process for drying the separated particles to produce a toner. The toner in the invention refers to one obtained by drying the aggregate produced in the fifth process.

In the first process, a polyester resin is first put in an organic solvent, and the polyester resin is dissolved and dispersed, thereby preparing a mixture containing the polyester resin and an organic solvent. In this case, one or more members selected various coloring agents, mold release agents or charge control agents, or other additives can be used together with the polyester resin as toner raw materials. In the invention, it is preferable to disperse the coloring agents together with the polyester resin in the organic solvent, and it is particularly preferable to similarly dissolve or disperse various additives, such as mold release agents or charge control agents.

It is preferable to use the following methods as measures for dissolving or dispersing various additives, such as coloring agents, mold release agents, and charge control agents, together with the polyester resin in an organic solvent.

As a first method, a method can be mentioned that includes kneading a mixture containing the polyester resin and various additives, such as coloring agents, mold release agents, and charge control agents, using a pressurization kneader, two heating rolls, a biaxial extrusion kneader, etc., while heating the polyester resin to be used to a temperature equal to or higher than softening point and equal to or lower than the thermal decomposition temperature. In the method, the coloring agents or the like may be melted and kneaded as a master batch. The method includes dissolving or dispersing the obtained kneaded chip in an organic solvent with stirrers, such as Desper (manufactured by Asada Iron Works Co., Ltd.).

As a second method, the polyester resin and various additives, such as coloring agents, mold release agents, and charge control agents, are mixed with an organic solvent, and the mixture is wet-kneaded in a ball mill or the like. In this case, the coloring agents, mold release agents, etc., may be separately preliminarily dispersed beforehand, and then mixed.

As measures for blending the polyester resin and other ingredients, a method can be mentioned that includes adding a resin solution in which the polyester resin has been dissolved in an organic solvent beforehand and coloring agents or mold release agents in a mixing/dispersion device using a medium, such as a ball mill, a beads mill, a sand mill, or a continuous beads mill, stirring/dispersing the mixture to form a master batch, and further mixing a polyester resin for dilution and an additional organic solvent to thereby produce a resin solution in which coloring agents or mold release agents are finely dispersed in an organic solvent.

In this case, it is preferable to use a master batch obtained by kneading/dispersing a low-viscosity polyester resin and coloring agents or mold release agents by a pressurization kneader and two heating rolls beforehand rather than directly putting coloring agents or mold release agents as they are in mixing/dispersing devices, such as a ball mill.

According to the production method, a gel component which is a polymer component of the polyester resin is not cut. Thus, the production method is more preferable than the first method including simply dispersing by melting and kneading.

As the organic solvent for dissolving or dispersing the coloring agents, the mold release agents, etc., to be used together with the polyester resin, hydrocarbons such as pentane, hexane, heptane, benzene, toluene, xylene, cyclohexane, and petroleum ether; ketones, such as acetone, methyl ethyl ketone, and methyl isobutyl; esters, such as ethyl acetate and butyl acetate, etc., are used. Two or more kinds of the solvents can be mixed for use, but it is preferable to use the same kind of solvent singly from the viewpoint of solvent recovery. The organic solvent dissolves a binder resin and organic solvents having a relatively low toxicity and having a low boiling point for ease of solvent removal in the following process. As such a solvent, methylethylketone is the most preferable.

As a method for emulsifying a mixture containing the polyester resin and the organic solvent in an aqueous medium, a method is preferable that includes mixing a mixture in which coloring agents or the like to be used together with the polyester resin and the organic solvent are adjusted by the method described above with an aqueous medium in the presence of a basic neutralizer. In this process, a method is preferable that includes gradually adding an aqueous medium which is a liquid containing water or water as the main ingredients to the mixture containing the polyester resin, coloring agents or the like, and the organic solvent. In that case, by gradually adding water to the organic continuous phase of the mixture, a discontinuous phase in which an aqueous phase is present in an oil phase generates. Further, by additionally adding water, the phase is converted to a discontinuous phase containing an oil phase in an aqueous phase, and a suspended/emulsified liquid in which the mixture is suspended as particles, i.e., liquid droplets, in an aqueous medium is formed. Hereinafter, the change from a discontinuous phase in which an aqueous phase is present in an oil phase to a discontinuous phase containing an oil phase in an aqueous phase as described above is also referred to as phase inversion emulsification.

In the phase inversion emulsification, water is added so that the proportion of the water relative to the total amount of the organic solvent and the water is 30 to 70% by mass. The proportion of the water is more preferably 35 to 65% by mass and particularly preferably 40 to 60% by mass. The aqueous medium to be used is preferably water.

The polyester resin to be used in the invention is preferably an acidic group containing polyester resin and is preferably a polyester resin having self-water dispersibility allowing stable dispersion in water by neutralizing the acidic group (hereinafter also referred to as self-water dispersible resin). The acid value of the self-water dispersible polyester resin to be used in the invention is preferably 1 to 20. The resin having self-water dispersibility is converted to an anionic type when the acidic group is neutralized with a basic neutralizer. As a result, the hydrophilicity of the resin increases, and thus the resin can be stably dispersed in an aqueous medium even when a dispersion stabilizer or a surfactant is not used. Examples of the acidic group include acidic groups, such as a carboxyl group, a sulfonic acid group, and a phosphate group and, in particular, the carboxyl group is preferable in terms of charge properties of a toner. Examples of the basic substances for neutralization include inorganic bases, such as sodium hydroxide, potassium hydroxide, and ammonia water or organic bases, such as diethylamine, triethylamine, and isopropylamine. Among the above, inorganic bases, such as ammonia water, sodium hydroxide, and potassium hydroxide, are preferable.

In order to disperse the polyester resin in an aqueous medium, a method including adding a suspension stabilizer or a dispersion stabilizer, such as a surfactant, is mentioned. However, a method including adding and emulsifying a suspension stabilizer or a surfactant requires high shearing force. As a result, coarse particles generate and the particle size distribution becomes broad, and thus the method is not preferable. Therefore, it is preferable in the invention to use a self-water dispersible resin and neutralize the acidic group of the resin by a basic compound.

Examples of methods for neutralizing the carboxyl group which is an acidic group of the polyester resin by a base include a method including producing a mixture containing a polyester resin having an acidic group, a coloring agent, a wax, and an organic solvent, and then neutralizing the mixture by a base or a method including mixing a basic neutralizer beforehand in an aqueous medium, and then neutralizing an acidic group of a polyester resin contained in the mixture during phase inversion emulsification.

Examples of the phase inversion emulsification method include a method for adding the mixture to an aqueous medium and emulsifying or a method in which a method for producing a mixture containing a polyester resin having an acidic group, a coloring agent, a wax, and an organic solvent and then neutralizing the mixture by a base and a method for adding an aqueous medium to the mixture are combined. The latter method is preferable because the particle size distribution becomes narrow.

In the phase inversion emulsification, various dispersing devices can be used. However, the stirring conditions in unifying are important for proceeding uniform unification, rather than using the dispersing devices to which a high share is applied. For example, an anchor blade, a turbine blade, a Pfaudler blade, a fullzone blade, a Maxblend blade (registered trademark), a half moon blade, etc., are used. In particular, it is preferable to use large-sized blades having a low rotation rate but having excellent uniform mixing properties, such as the Maxblend blade or the full zone blade. The circumferential speed of the stirring blades for generating a uniform unified substance is preferably 0.2 to 10 m/s and stirring at a low share of 0.2 to lower than 8 m/s is more preferable. The circumferential speed of the stirring blades is particularly preferably 0.2 to 6 m/s. When the circumferential speed of the stirring blades is higher than 10 m/s, fine particles remain. Thus, such a circumferential speed is not preferable.

In contrast, when the circumferential speed is lower than 0.2 m/s, there is a tendency that the stirring becomes non-uniform, the phase inversion does not uniformly occur, and coarse particles generate. Thus, such a circumferential speed is not preferable. When the temperature during the phase inversion emulsification is higher, coarse particles more frequently generate, and thus a higher phase inversion emulsification temperature is not preferable. In contrast, when the temperature during the phase inversion emulsification is excessively low, the viscosity of a mixture containing a polyester resin and an organic solvent increases and the frequency of the generation of coarse particles increases. Thus, a lower phase inversion emulsification temperature is not preferable. The temperature during the phase inversion emulsification is preferably in the range of 10 to 40° C. The temperature during the phase inversion emulsification is more preferably in the range of 20 to 30° C.

As described above, when the phase inversion emulsification is performed at a low share using the self-water dispersible resin, the generation of fine powder or coarse particles can be suppressed. As a result, the production of an aggregate of fine particles having a uniform particle size distribution can be facilitated in the following unifying process. Furthermore, the use of a polyester resin having no self-water dispersibility or the phase inversion emulsification performed at a high share causes problems such that coarse particles generate or low molecular weight ingredients of resin cause the generation of fine powder, which makes the particle size distribution of toner particles broad and further particles containing low molecular weight ingredients are removed by sieving or the like performed in a subsequent process to deteriorate the low temperature fixability of a toner. However, such problems do not occur by the use of the self-water dispersible resin or by performing the phase inversion emulsification at a low share.

The 50% volume average particle size of the fine particles produced in the first process is in the range of more than 1 μm to 6 μm or lower and more preferably in the range of more than 1 μm to 4 μm. When a coloring agent or a mold release agent is used at a 50% volume average particle size thereof of 1 μm or lower, the particles are not covered with a polyester resin. Thus, adverse effects are exerted on the charge properties and the development properties. Thus, such a volume average particle size is not preferable. In contrast, when the particle size of the fine particles is large, the particle size of a toner to be obtained is limited. Thus, it is required to make the particle size of the fine particles smaller than a target toner particle size. When the particle size of the fine particles is larger than 6 μm, coarse particles are likely to generate. Thus, such a particle size is not preferable. In the particle size distribution of fine particles produced in the first process, the proportion of the volume particle size of 10 μm or more is 2% or lower and more preferably 1% or lower and the proportion of the volume particle size of 5 μm or more is 10% or lower and more preferably 6% or lower.

In the second process, an aggregate of fine particles obtained in the first process by unifying the fine particles is generated, thereby forming toner particles having a desired particle size. In the second process, a desired aggregate can be obtained by controlling as appropriate the amount of solvents, the temperature, the type or added amount of dispersion stabilizers and electrolytes, the stirring conditions, etc.

According to the production method of the invention, an aggregate can be obtained in a single-stage process including a deposition process simultaneously with aggregation and spherical or approximately spherical particles can be provided without warming in a short time.

In the second process of the invention, a dispersion liquid of the fine particles obtained in the first process is diluted with water to adjust the amount of solvents. Thereafter, the unification of the fine particles is proceeded by adding a dispersion stabilizer, and adding dropwise an aqueous electrolyte solution in the presence of the dispersion stabilizer, thereby obtaining an aggregate having a given particle size.

The fine particles formed from the self-water dispersible resin obtained until when the first process is completed are stably dispersed in an aqueous medium due to the action of an electric double layer by a carboxylic acid salt. In the second process of the invention, the particles are destabilized by adding an electrolyte that breaks or diminishes the electric double layer to an aqueous medium in which the fine particles are dispersed. Examples of the electrolytes usable in the invention include acidic substances, such as hydrochloric acid, sulfuric acid, phosphoric acid, acetic acid, and oxalic acid. In addition, water-soluble organic or inorganic salts, such as sodium sulfate, ammonium sulfate, potassium sulfate, magnesium sulfate, sodium phosphate, sodium dihydrogen phosphate, sodium chloride, potassium chloride, ammonium chloride, calcium chloride, and sodium acetate, can be effectively used as the electrolyte. These electrolytes to be added for unifying may be used singly or in combination or two or more kinds thereof. In particular, sulfuric acid salts of monovalent cation, such as sodium sulfate or ammonium sulfate, are preferable in terms of proceeding uniform unification. According to the production method of the invention, the fine particles obtained in the first process are swollen by solvents and are in an unstable state where the electric double layer of the particles shrinks due to the addition of the electrolyte. Thus, the unification of the particles easily proceeds even by collision of the particles by stirring at low shear (low shearing force).

Only by the addition of the electrolyte, the dispersion stability of the fine particles in the system is destabilized, and thus the unification becomes non-uniform and coarse particles or aggregates generate. In order to prevent the aggregate of fine particles produced due to the electrolyte or acidic substances from repeating re-unification to form an aggregate having a particle size larger than a target particle size, it is required to add inorganic dispersion stabilizers, such as hydroxyapatite, or ionic or nonionic surfactants as a dispersion stabilizer before adding the electrolytes or the like. The dispersion stabilizer to be used is required to have properties of holding dispersion stability even in the presence of the electrolytes to be added later.

Examples of the dispersion stabilizer having such properties include polyoxyethylene nonylphenyl ether, polyoxyethylene octylphenyl ether, polyoxyethylene dodecyl phenyl ether, polyoxyethylene alkyl ether, polyoxyethylene fatty acid ester, sorbitan fatty acid ester, polyoxyethylene sorbitan fatty acid ester, nonionic emulsifying agents, such as Pluronics, alkyl sulfonate salt type anionic emulsifier, and quaternary ammonium salt type cationic dispersion stabilizer. In particular, anionic and nonionic dispersion stabilizers are preferable because the dispersion stabilizers are effective for dispersion stability of the system even when the added amount thereof is small. The clouding point of nonionic surfactants is preferably 40° C. or higher. The surfactants mentioned above may be used singly or as a mixture of two or more kinds thereof. According to the production method of the invention, non-uniform unification can be prevented by adding the electrolyte in the presence of the dispersion stabilizer (emulsifier), and, as a result, a sharp particle size distribution range is obtained, and thus an increase in the yield is achieved.

In the second process of the invention, a dispersion liquid of the obtained particles may be diluted with water. Thereafter, the dispersion stabilizer and the electrolyte are successively added and unified. Or, it is preferable to employ a procedure including adjusting the amount of solvents in the dispersion liquid by adding an aqueous solution of the dispersion stabilizer and/or the electrolyte to thereby obtain particles having a given particle size. The amount of solvents to be contained in the system after adding the electrolyte is preferably in the range of 5 to 25% by mass. The amount thereof is more preferably in the range of 5 to 20% by mass and particularly preferably in the range of 5 to 18% by mass. When the amount of solvents is smaller than 5% by mass, the amount of the electrolytes required for unification increases. Thus, such an amount is not preferable. When the amount of solvents is larger than 25% by mass, the generation of aggregates due to non-uniform unification frequently occurs and the added amount of dispersion stabilizers increases. Thus, such an amount is not preferable.

In the invention, the shape of toner particles after unification can be adjusted by adjusting the amount of solvents. When the amount of solvents is in the range of 13 to 25% by mass, the degree of swelling of fine particles due to the solvents is high. Thus, spherical or approximately spherical particles can be easily obtained by unification. In contrast, when the amount of solvents is adjusted in the range of 5 to 13% by mass, the degree of swelling of fine particles due to solvents is low. Thus, deformed or approximately spherical particles are easily obtained.

The amount of the dispersion stabilizers to be used is preferably in the range of 0.5 to 3.0% by mass relative to the solid content of fine particles, for example. The amount thereof is more preferably in the range of 0.5 to 2.5% by mass and particularly preferably in the range of 1.0 to 2.5% by mass. When the amount thereof is smaller than 0.5% by mass, target prevention effects against the generation of coarse particles are not obtained. In contrast, when the amount thereof is larger than 3.0% by mass, the unification does not sufficiently proceed even when the amount of electrolytes is increased, and particles having a given particle size are not obtained, which results in the fact that fine particles remain and the yield decreases. Thus, such an amount is not preferable.

The amount of the electrolytes to be used is preferably in the range of 0.5 to 15% by mass relative to the solid content of fine particles. The amount thereof is more preferably in the range of 1 to 12% by mass and particularly preferably in the range of 1 to 10% by mass. When the amount of electrolytes is smaller than 0.5% by mass, the unification does not sufficiently proceed. Thus, such an amount is not preferable. When the amount of electrolytes is larger than 15% by mass, the unification becomes non-uniform, and the generation of aggregates and coarse particles occurs to reduce the yield. Thus, such an amount is not preferable.

The temperature during unification is preferably in the range of 10 to 50° C. The temperature is more preferably in the range of 20 to 40° C. and particularly preferably in the range of 20 to 35° C. When the temperature is lower than 10° C., the unification becomes difficult to proceed, and thus such a temperature is not preferable. When the temperature is higher than 50° C., the unification rate becomes high, and thus aggregates or coarse particles are likely to generate. Thus, such a temperature is not preferable. According to the production method of the invention, the generation of aggregates by unification can be achieved at temperatures as low as 20 to 40° C., for example. Therefore, it is not required to increase the temperature to 80 to 90° C. for fusing fine particles after aggregating, which has been required in an aggregation method.

Various embodiments can be employed in the first process including phase inversion emulsification and the second process including unification in the invention.

In particular, the following embodiments can be mentioned as preferable embodiments:

Method including producing fine particles according to the first process using a resin solution containing a polyester resin and a coloring agent or, further, a mold release agent and a charge control agent, and performing the second process;

Method including producing fine particles according to the first process using a resin solution containing a polyester resin and a coloring agent or, further, a mold release agent, mixing a charge control agent dispersion liquid, and performing the second process;

Method including producing fine particles containing a polyester resin according to the first process, separately preparing a coloring agent dispersion liquid and/or, further, at least one of a mold release agent dispersion liquid and a charge control agent dispersion liquid, mixing the same, and performing the second process; and Method including producing fine particles according to the first process using a resin solution containing a polyester resin and a mold release agent, mixing a dispersion liquid of a coloring agent or, further, a dispersion liquid of a charge control agent, and performing the second process.

The respective dispersion liquids to be used here, such as the coloring agent dispersion liquid, the charge control agent dispersion liquid, and the mold release agent dispersion liquid, can be obtained as follows. For example, the dispersion liquids can be prepared by adding each substance and nonionic surfactants typified by polyoxyethylene alkyl phenyl ether and the like, anionic surfactants typified by alkyl benzene sulfonate, alkyl sulfate salt, etc., or cationic surfactants typified by quaternary ammonium salt to water, using a mechanically pulverizing method by a medium.

Or, the dispersion liquids can be prepared by using the self-water dispersible polyester resin in place of the surfactants in the presence of a basic neutralizer by the same dispersing measure. The coloring agents, mold release agents, and charge control agents to be used here may be melted and kneaded with a polyester resin beforehand. In this case, by adsorption of the resin, the degree in which each material is exposed to the particle surface is reduced, and preferable charge properties and development properties are imparted.

In order to favorably hold frictional chargeability, it is effective that the coloring agent or the like is prevented from being exposed to the toner particle surface, i.e., it is effective to have a toner structure in which the coloring agent or the like is enclosed in toner particles. The degradation of charge properties associated with a reduction in a toner particle size is also considered to be caused by the fact that the contained coloring agent or other additives, such as a wax, is partially exposed to the toner particle surface.

More specifically, even when the content of the coloring agent or the like is the same, the surface area of toner particles increases due to a reduction in the particle size, and the proportion of the coloring agent, wax, etc., exposed to the toner particle surface increases. As a result, the composition on the toner particle surface greatly changes and the frictional chargeability of the toner particles greatly changes. Thus, appropriate charge properties are difficult to obtain.

In the toner particles produced by the invention, it is preferable that the coloring agent, wax, etc., be enclosed in a binder resin. By the structure as described above, excellent printed images are obtained. In order to positively enclose the coloring agent or the mold release agent, it is preferable to perform a method including producing fine particles according to the first process using the above-mentioned resin solution containing a polyester resin and a coloring agent or, further, a mold release agent and a charge control agent, and performing the second process or it is preferable to perform a method including producing fine particles according to the first process using a resin solution containing a polyester resin and a coloring agent or further a mold release agent, mixing a charge control agent dispersion liquid, and performing the second process.

The aggregate of fine particles obtained in the second process is preferably spherical and it is preferable that the average circularity be 0.96 or more. In the shape of unified particles obtained in a unifying process, the ratio of the circumferential length of a circle equivalent to a projected area of a particle image observed using a particle image analyzer (Flow particle image analyzer, FPIA-1000, manufactured by SYSMEX CORPORATION) or the like to the circumferential length of a projected image of the observed particles is defined as an average circularity.

When the particles have an approximately spherical shape or a spherical shape having an average circularity of 0.96 or more, the powder flowability and the transfer efficiency are excellent and the separation efficiency becomes high also when fine particles are separated from a dispersion liquid by the method of the invention.

The dispersion liquid of the aggregate of the particles obtained in the second process is subjected to removal of solvent in the third process, and the organic solvent is removed from a slurry.

Subsequently, in the fourth process, the dispersion obtained in the third process in which particles are dispersed in an aqueous medium is classified in liquid and dehydrated.

Figure 2A:
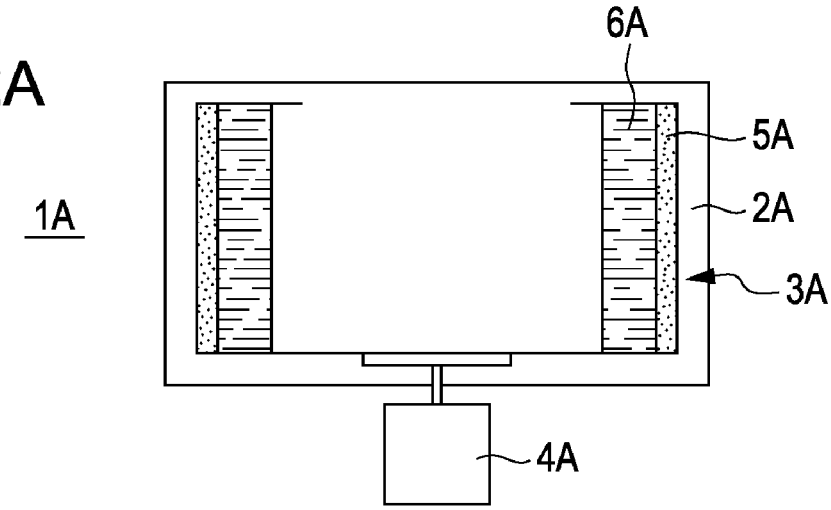
FIG. 2A is a view illustrating a classifying and drying method of the invention.
Figure 2B:
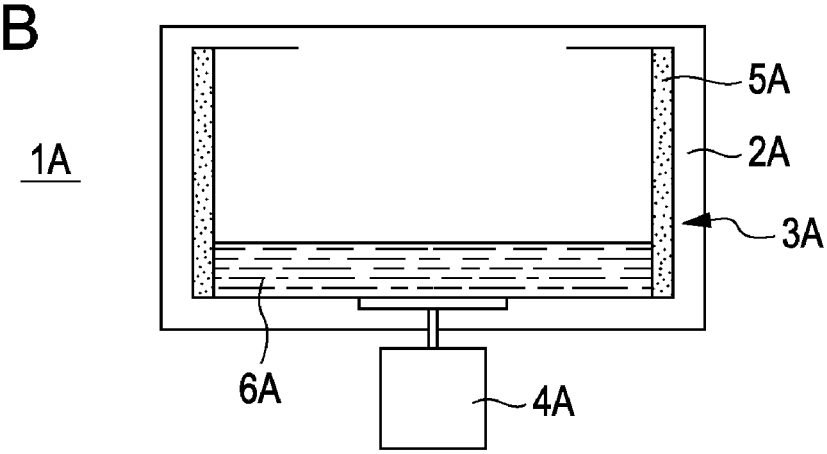
FIG. 2B is a view illustrating a classifying and drying method of the invention.
Figure 2C:
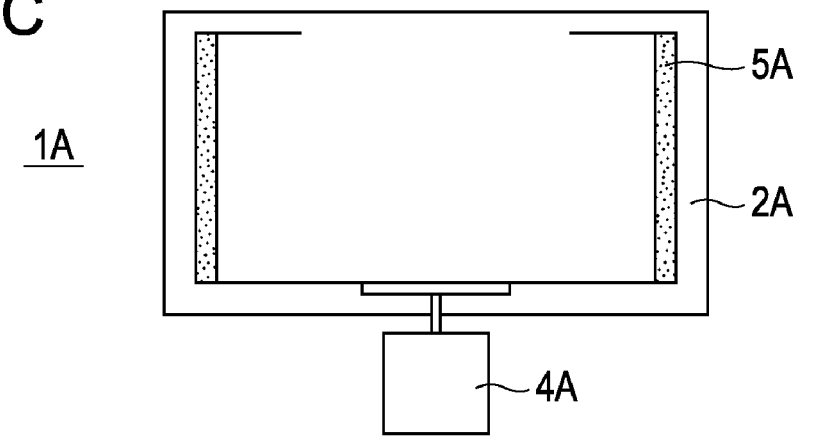
FIG. 2C is a view illustrating a classifying and drying method of the invention.

FIG. 2 is a view illustrating a classifying and dehydrating method of the invention. FIG. 2(A) is a view illustrating a state where centrifuge force is given by rotation, FIG. 2(B) is a view illustrating a state where the rotation is stopped, and FIG. 2(C) is a view illustrating a state where a remaining dispersion liquid is removed. FIGS. 2(A) to 2(C) are all cross sectional views.

A classifying and dehydrating device 1A of the invention has a nonporous cylindrical tank 3A having the rotation axis in the perpendicular direction in an exterior body 2A. When a dispersion liquid is poured in the cylindrical tank 3A, and rotated by applying centrifuge force by a driving device 4A, a particle layer 5A in which the particles adhere in the form of a cake is formed on the non-porous wall surface of the cylindrical tank 3A and also a dispersion layer 6A in which the content of the particles decrease due to the adhesion of the particles to the inner wall surface of the cylindrical tank 3A is formed thereinside as shown in FIG. 2(A).

The rotation of the cylindrical tank 3A is stopped, and a residual dispersion liquid 7A on the bottom of the cylindrical tank 3A is removed as shown in FIG. 2(B). Thereafter, the particle layer 5A adhering to the inner wall surface of the cylindrical tank 3A in the shape of a cake as shown in FIG. 2(C) is stripped from the inner surface wall and dried. Thus, toner particles can be produced. The dispersion liquid may be removed after the rotation is stopped or may be removed as a supernatant liquid by skimming during rotation.

The particle layer 5A adhering to the inner wall surface of the cylindrical tank 3A in the shape of a cake as shown in FIG. 2(C) is stripped from the inner wall surface, and then an aqueous medium, such as water, is added to prepare a dispersion liquid. Thereafter, the cylindrical tank 3A is rotated to make the particles adhere to the inner wall surface of the cylindrical tank 3A. Thereafter, the dispersion liquid inside the cylindrical tank is removed. By repeating the process, classification of fine powder particles and removal of chemical agents used during the formation of the particles can be performed.

Thus, the process including adding an aqueous medium, such as water, to the particle layer adhering in the shape of a cake to prepare a dispersion liquid again, and classifying particles using a centrifuge is preferably repeated twice to 7 times.

In the invention, it is preferable to apply a centrifuge force of 500 to 900 G to a dispersion liquid by the rotation of the cylindrical tank 3A. When the centrifuge force is lower than 500 G, the formation of the particle layer from the dispersion liquid onto the inner wall surface of the cylindrical tank 3A is insufficient, and thus the recovery of the particles from the dispersion liquid decreases. In contrast, when the centrifuge force is higher than 500 G, the fine powder particles contained in the dispersion liquid are strongly taken into the particle layer 5A on the inner wall surface of the cylindrical tank 3A. Therefore, the classification of the fine powder particles becomes insufficient. Thus, when the residual dispersion liquid is discharged, particles of 2.5 μm or lower are not sufficiently removed.

The application time of centrifuge force of 500 to 900 G is preferably 5 to 30 minutes. When the application time is shorter than 5 minutes, the formation of the particle layer 5A from the dispersion liquid onto the inner wall surface of the cylindrical tank 3A is insufficient, and the recovery of the particles from the dispersion liquid decreases. In contrast, when the application time is longer than 30 minutes, the fine powder particles contained in the dispersion liquid are strongly taken into the particle layer 5A on the inner wall surface of the cylindrical tank 3A. Therefore, the classification of the fine powder particles becomes insufficient. Thus, when the residual dispersion liquid is discharged, particles of 2.5 μm or lower are not sufficiently removed.

By drying the cake of the colored resin particles obtained by classification as described above, toner base particles can be obtained. The process includes removing moisture and residual volatilization components by applying thermal energy, and forming toner base particles. Therefore, a higher drying temperature is efficient. However, the toner base particles are fused with each other at a temperature equal to or higher than the glass transition temperature Tg of resin. Therefore, the temperature in the system is preferably equal to or lower than the glass transition temperature Tg. The drying is preferably performed so that the residual moisture amount is smaller than 0.5% in terms of toner properties.

Examples of drying methods include a method for drying under a normal pressure or a reduced pressure, a freeze-drying method, and a method for simultaneously performing the separation of the toner particles from the aqueous medium and drying the same using a spray drier. In particular, a method for stirring and drying powder under a reduced pressure while heating at a temperature where the toner particles are not thermally fused or aggregated or a method using, for example, an air stream drier (Flash Jet Drier, manufactured by Seishin Kigyou Co., Ltd.) which dries in a moment using a heating and drying air current is efficient and preferable.

In the invention, with reference to the toner particle size distribution, the 50% volume particle size/50% number particle size is 1.25 or lower and more preferably 1.20 or lower in terms of the measurement by a Beckman Coulter multisizer 3 (aperture tube diameter: 50 μm). The 50% volume particle size/50% number particle size of 1.25 or lower is preferable because favorable images are obtained. The GSD is preferably 1.30 or lower and more preferably 1.25 or lower. The GSD is a value determined by the square root of (16% volume particle size/84% volume particle size) in the measurement by the multisizer 3 manufactured by Coulter. When the GSD value is smaller, the particle size distribution becomes sharp, and favorable images are obtained.

When a toner in which the volume average particle size thereof is set to 3 to 6 μm in terms of the number mode diameter is produced as a toner obtained by the method of the invention, effects of the classification in liquid is high. Even when particles of 2.5 μm or lower whose frequency is low under the conditions that the number mode diameter is larger than 6 μm, the classification effects sharply decrease. When a toner smaller than 3 μm is classified by 2.5 μm, the yield decreases and thus such classification is industrially impracticable.

The proportion of particles adhering to the inner wall surface of the cylindrical tank, and then remaining in a dispersion liquid is excessively high, the classification accuracy decreases and the particle distribution becomes broad. Therefore, when the number mode diameter is 3 μm or more and 6 μm or lower, classification can be performed so that the smallest particle size distribution can be achieved.

The polyester resin to be used in the invention is synthesized by dehydration condensation of polybasic acids and polyhydric alcohols.

Examples of the polybasic acids include aliphatic carboxylic acids, such as terephthalic acid, isophthalic acid, phthalic acid anhydride, trimellitic acid anhydride, pyromellitic acid, or naphthalene dicarboxylic acid; aromatic carboxylic acids; such as maleic acid anhydride, fumaric acid, succinic acid, or alkenyl succinic acid anhydride, or adipic acid; and alicyclic carboxylic acids, such as cyclohexanedicarboxylic acid. These polybasic acids can also be used singly or in combination of two or more kinds thereof. Among the above polybasic acids, it is preferable to use the aromatic carboxylic acids.

Examples of the polyhydric alcohols include aliphatic diols, such as ethylene glycol, diethylene glycol, triethylene glycol, propylene glycol, butanediol, hexanediol, neopentylglycol, glycerin, trimethylolpropane, or pentaerythritol; alicyclic diols, such as cyclohexanediol, cyclohexanedimethanol, or hydrogenated bisphenol A; and aromatic diol, such as an ethylene oxide adduct of bisphenol A or a propylene oxide adduct of bisphenol A. These polyhydric alcohols can also be used singly or in combination of two or more kinds thereof. Among the above polyhydric alcohols, the aromatic diols and alicyclic diols are preferable, and the aromatic diols are more preferable.

By further adding monocarboxylic acids and/or monoalcohols to the polyester resin obtained by condensation polymerization of polyvalent carboxylic acids and polyhydric alcohols, the hydroxyl group and/or the carboxyl group in the polymerization end can be etherified to adjust the acid value of the polyester resin. Examples of the monocarboxylic acids used for such a purpose, acetic acid, acetic acid anhydride, benzoic acid, trichloroacetic acid, trifluoroacetic acid, and propionic acid anhydride. Examples of the monoalcohols include methanol, ethanol, propanol, octanol, 2-ethyl hexanol, trifluoroethanol, trichloroethanol, hexafluoroisopropanol, and phenol.

The polyester resin can be produced by a condensation reaction of the polyhydric alcohols and the polyvalent carboxylic acids. For example, the above-mentioned polyhydric alcohols and polyvalent carboxylic acids are put in a reactor provided with a thermometer, a stirrer, and a fluid capacitor, the reactor is heated at 150 to 250° C. under an atmosphere, which does not exert adverse effects on reactions of nitrogen or the like, produced low molecular compounds are continuously removed outside the reaction system, the reaction is stopped when physical property values reach desired values, and then the resultant is cooled, whereby a target reaction product can be obtained.

Such a synthesis of the polyester resin can also be achieved by the addition of a catalyst. Examples of esterifying catalysts to be used include organic metals, such as dibutyltin dilaurate and dibutyltin oxide or metal alkoxides, such as tetrabutyl titanate. When the carboxylic acid component to be used is lower alkyl ester, ester exchange catalysts can be used. Examples of the ester exchange catalysts include metal acetates, such as zinc acetate, lead acetate, or magnesium acetate; metal oxides, such as zinc oxide or antimony oxide, and metal alkoxides, such as tetrabutyl titanate. The added amount of the catalysts is preferably in the range of 0.01 to 1% by mass relative to the total amount of raw materials.

In order to produce particularly branched or crosslinked polyester resins in such a condensation polymerization reaction, at least one member of polybasic acids having 3 or more carboxyl groups in one molecule or anhydrides thereof and polyvalent alcohols having 3 or more hydroxyl groups in one molecule may be used as raw materials.

The toner of the invention has a flow softening temperature (Tf1/2) in the range of 90° C. to 140° C. and a glass transition temperature in the range (Tg) of 40° C. to 70° C. The flow softening temperature (Tf1/2) is a value measured using a fluidity evaluation device (Flow tester CFT-500, manufactured by Shimadzu Corp.) at a temperature elevation rate of 6° C./m while setting the nozzle diameter to 1.0 mm×1.0 mm and applying a pressure of 0.98 MPa. The glass transition temperature Tg is a value measured at a temperature elevation rate of 10° C./m by a second run method using a differential scanning calorimeter (DSC-220C manufactured by Seiko Instruments).

It is more preferable to contain a high-viscosity crosslinked polyester resin and a low viscosity branched or linear polyester resin as a binder resin. More specifically, in the polyester resin of the invention, the binder resin may be constituted by one kind of polyester resin. However, it is practical and preferable to blend a crosslinked polyester resin generally having a high molecular weight and a high viscosity, i.e., a crosslinked polyester resin, and a branched or linear polyester resin having a low molecular weight and a low viscosity for use in terms of the resin structure and obtaining a favorable fixation starting temperature and hot offset resistance. When blending for use, the flow tester value of the blended resin may be in the range of the numerical range mentioned above. In the invention, the crosslinked polyester resin refers to a resin having an ingredient insoluble in tetrahydrofuran and the branched or linear polyester resin refers to a resin that has no gel content in the measurement of the gel content and is soluble in tetrahydrofuran.

In the invention, a plurality of polyester resins different in the melt viscosity can be used as the binder resin. For example, when a mixture of a low-viscosity branched or linear polyester resin and a high-viscosity crosslinked polyester resin is used, a mixture of a branched or linear polyester resin A and a crosslinked polyester or branched polyester resin B having the following conditions is more preferable. In this case, the melt viscosity and the blending amount of the resin A and the resin B are adjusted as appropriate so that the flow tester value of the blended resin is in the numerical value range mentioned above.

More specifically, a branched or linear polyester resin having a T1/2 temperature measured by a flow tester of 80° C. or more and lower than 120° C. and a glass transition temperature Tg of 40° C. to 70° C. is used as the polyester resin A and a crosslinked or branched polyester resin having a T1/2 temperature measured by a flow tester of 120° C. or more and 210° C. or lower and a glass transition temperature Tg of 50° C. to 70° C. is used as the polyester resin B. Furthermore, the mass ratio of the polyester resin A and the polyester resin B is:

$$A/B = 20/80 \text{ to } 80/20.$$

When the T1/2 temperatures of the polyester resin A and the polyester resin B are defined as T1/2 A and T1/2 B, respectively, polyester resins satisfying the relationship of 20° C.<T1/2 (B)−T1/2 (A)<100° C. are preferably used.

Considering the temperature properties by a flow tester, the melting temperature T1/2A by a 1/2 method of the resin (A) serves as the index for imparting sharp melt properties and low-temperature fixability. The T1/2A is more preferably in the range of 80 to 115° C. and particularly preferably in the range of 90 to 110° C.

The resin A specified by such properties has a low softening temperature. Even when, in a fixing process using a heat roll, a given thermal energy decreases due to a reduction in the temperature of the heat roll or an increase in the process rate, the resin sufficiently melts and exhibits excellent cold offset resistance and low-temperature fixability.

When both the melting temperature T1/2B and the outflow completion temperature TendB by the ½ method of the resin B are excessively low, hot offset is likely to occur. When both the temperatures are excessively high, the particle size distribution during particle formation deteriorates to reduce the productivity. Therefore, the T1/2(B) is more preferably 125° C. to 210° C. and particularly preferably 130° C. to 200° C.

The resin B specified by the properties have high rubber elasticity and a high melt viscosity. Therefore, the internal cohesive force of a molten toner layer is maintained even during heat melting in a fixing process, hot offset is hard to occur, and excellent abrasion resistance is demonstrated due to the toughness even after fixing.

By blending the resin A and the resin B at a given blending ratio, a toner that sufficiently satisfies offset resistance and low-temperature fixability in a large temperature range can be provided.

When the mass ratio A/B of the resin A and the resin B is excessively low, the fixability is affected. When the mass ratio A/B is excessively high, the offset resistance is affected. Thus, the mass ratio A/B is preferably 20/80 to 80/20 and more preferably 30/70 to 70/30.

When the melting temperatures of the resin A and the resin B by the ½ method are defined as T1/2A and T1/2B, respectively, the range of T1/2B-T1/2A is preferably higher than 20° C. and 90° C. or lower and particularly preferably higher than 20° C. and 80° C. or lower from the viewpoint of achieving both low-temperature fixability and offset resistance and ease of uniform mixing without causing problems due to differences in the viscosity between the resins.

The glass transition temperature (Tg) in the invention is a value obtained by measuring at a temperature elevation rate of 10° C./m by a second run method using a differential scanning calorimeter (DSC-50) manufactured by Shimadzu Corp., in the invention.

When the Tg of the polyester resin (A) is lower than 40° C. or the Tg of the polyester resin (B) is lower than 50° C., a toner to be obtained is likely to cause blocking (a phenomenon in which toner particles aggregate to form a lump) during storage or in a development device. Thus, such a temperature is not preferable. In contrast, when the Tg of the polyester resin (A) exceeds 70° C. or when the Tg of the polyester resin (B) exceeds 75° C., the fixing temperature of the toner becomes high. Thus, such a temperature is not preferable. Thus, by the use of the polyester resin (A) and the polyester resin (B) that satisfy the above-described relationship as the polyester resin serving as a binder resin, a toner to be obtained is imparted with favorable fixability. Thus, the use thereof is preferable.

It is preferable for a binder resin containing polyester resin, in terms of obtaining favorable fixability, to satisfy that the mass average molecular weight in terms of a molecular weight measurement by a gel permeation chromatography (GPC) method for a tetrahydrofuran (THF) soluble content is 30,000 or more and preferably 37,000 or more, a ratio of Weight average molecular weight (Mw)/Number average molecular weight (Mn) is 12 or more and preferably 15 or more, the area ratio of components having a molecular weight of 600,000 or more is 0.3% or more and preferably 0.5% or more, and the area ratio of components having a molecular weight of 10,000 or lower is 20 to 80% and preferably 30 to 70%. When two or more resins are blended, the GPC measurement results of a final resin mixture may be in the numerical value range mentioned above.

In the polyester resin to be used in the production method of the invention, high molecular weight components having a molecular weight of 600,000 or more have a function of securing hot offset resistance. In contrast, low molecular weight components having a molecular weight of 10,000 or lower are effective for reducing the melt viscosity of the resin, developing sharp melt properties, and reducing a fixing start temperature. Thus, it is preferable to contain resin components having molecular weight of 10,000 or lower. In order to obtain favorable thermal properties, such as low-temperature fixing by an oil-less fixing method, hot offset resistance, or transparency, it is preferable for the binder resin to have such a broad molecular weight distribution.

Here, the molecular weight of the THF soluble content of the binder resin is calculated as follows. A THF soluble substance is filtered by a 0.2 μm filter, the resultant is measured in a THF solvent (flow velocity of 0.6 ml/min, temperature of 40° C.) using GPC-HLC-8120 manufactured by Tosoh Corporation and three columns of "TSKgel Super HM-M" (15 cm) manufactured by Tosoh Corporation, and then the molecular weight is calculated using a molecular weight calibration curve created from a monodisperse polystyrene standard sample.

The acid value (mg number of KOH required for neutralizing 1 g of resin) of the polyester resin is preferably in the range of 1 to 20 mgKOH/g. This is because the above-described molecular weight distribution is easily obtained, the granulation properties of fine particles by emulsification distribution are easily secured, the environmental stability (charge stability when temperatures and humidities change) of a toner to be obtained is favorably maintained, etc.

The acid value of the polyester resin can be adjusted by controlling the carboxyl group in the polyester end based on the blending ratio and the reaction ratio of polybasic acids and polyhydric alcohols as raw materials in addition to further adding monocarboxylic acids and/or monoalcohols to the polyester resin obtained by condensation polymerization of polyvalent carboxylic acids and polyhydric alcohols as described above. Or, a substance having a carboxyl group in the main chain of polyester can be formed by using a trimellitic acid anhydride as a polybasic acid ingredient.

Mold release agents can be used for the toner of the invention. In such a case, as the mold release agents, a mold release agent selected from the group consisting of hydrocarbon-waxes, such as polypropylene wax, polyethylene wax, and Fisher-Tropsh wax, synthetic ester waxes, and natural ester waxes, such as carnauba wax and rice wax, is used. In particular, the natural ester waxes, such as carnauba wax and rice wax and synthetic ester waxes obtained from polyhydric alcohols and long chain monocarboxylic acids are preferably used. As the synthetic ester waxes, WEP-5 manufactured by Nippon Oil & Fats Co., Ltd. can be mentioned. The content of the mold release agents is preferably in the range of 1 to 40% by mass because when the content is lower than 1% by mass, the mold-release properties easily become insufficient and when the content exceeds 40% by mass, the waxes are likely to be exposed to the toner particle surface and the charge properties and the storage stability are likely to decrease.

In the toner of the invention, charge control agents can be blended. Positive charge control agents are not particularly limited, and nigrosine dyes, quaternary ammonium compounds, onium compounds, triphenylmethane compounds, etc., which are known to be used for toners, can be used. Moreover, compounds containing basic groups, such as amino groups, imino groups, and an N-hetero ring, e.g., tertiary amino group-containing styrene acrylic resins, have effects as the positive charge control agents and can be used singly or in combination with the positive charge control agents mentioned above as the positive charge control agents of the invention. Depending on the intended use, a small amount of negative charge control agents, such as azo dye metal complexes and metal complex salts of salicylic acid derivatives, can be used in combination with the positive charge control agents mentioned above. Examples of the negative charge control agents include heavy metal containing acid dyes, such as trimethyl ethane dyes, metal complex salts of salicylic acid, metal complex salts of benzilic acid, copper phthalocyanine, perylene, quinacridone, azo pigments, metal complex salt azo dyes, and azo chromium complexes, Calixarene phenol condensates, cyclic polysaccharides, and resins containing carboxyl groups and/or sulfonyl groups.

The content of the charge control agents is preferably 0.01 to 10% by mass. The content is particularly preferably 0.1 to 6% by mass.

Coloring agents to be used in the toner of the invention include carbon black, cyanine black, aniline black, ferrite, and magnetite as black pigments. Moreover, coloring agents obtained by blending the following chromatic color pigments in such a manner as to obtain black color can also be used.

Examples of yellow pigments include yellow iron oxide, ocher, titanium yellow, naphthol yellow S, Hanza Yellow 10G, Hanza Yellow 5G, Hanza Yellow G, Hanza Yellow GR, Hanza Yellow A, Hanza Yellow RN, Hanza Yellow R, Pigment Yellow L, Benzidine yellow, Benzidine yellow G, Benzidine yellow GR, Permanent Yellow NCG, Balkan fast yellow 5G, Balkan fast yellow R, quinoline yellow rake, Anthragen Yellow 6GL, Permanent Yellow FGL, Permanent Yellow H10G, Permanent Yellow HR, Anthrapyrimidine Yellow, Isoindolinone Yellow, Chromophtal yellow, Novoperm Yellow H2G, condensed azo yellow, nickel azo yellow, and copper azo methine yellow.

Examples of red pigments include molybdenum orange, permanent orange GTR, pyrazolone orange, balkan orange, indanthrene brilliant orange RK, indanthrene brilliant orange GK, benzidine orange G, permanent red 4R, permanent red BL, permanent red F5RK, lithol red, pyrazolone red, watching red, lake red C, lake red D, Brilliant Carmine 6B, Brilliant Carmine 3B, Rhodamine Lake B, Alizarine Lake, Permanent Carmine FBB, perynone orange, isoindolinone orange, anthroanthrone orange, pyrathrone orange, quinacridone red, quinacridone magenta, quinacridone Scarlett, and perylene red.

Examples of blue pigments include cobalt blue, cerulean blue, alkali blue rake, peacock blue rake, Phanatone blue 6G, Victoria blue rake, non-metal phthalocyanine blue, copper phthalocyanine blue, Fast sky blue, Indanthrene blue RS, Indanthrene blue BC, and Indigo.

The amount of the coloring agents to be used is preferably in the range of 1 to 50 parts by mass and particularly preferably in the range of 2 to 15 parts by mass based on 100 parts by mass of binder resin.

The dried toner particles can also used as they are as a development agent, but it is preferable to add externally-applied agents known as externally-applied agents for toners, such as inorganic oxide fine particles or organic polymer fine particles to the toner particle surface. Inorganic particles, such as hydrophobic silica and titanium oxide, or organic particles have effects for improving physical properties, such as flowability or charge properties, when externally applied to the toner particles and used as a dry developer by an electrostatic printing method.

By adding silicone oil as an externally-applied agent to the toner of the invention, scattering of the toner can be suppressed and scattering of fine powder can be further reduced in a toner having a low content of fine powder.

As the silicone oil, a dimethyl silicone oil having a kinetic viscosity at 25° C. of 50 to 500 $mm^2/s$ can be mentioned.

The silicone oil can be prepared by stirring at a circumferential speed of a blade tip of 10 to 60 m/sec irrespective of the scale, after added to the toner.

When alumina fine particles in which the phase angle (θ) in an alternating frequency range of 1 kHz to 10 kHz measured by an alternating impedance method is 80° or lower in terms of the absolute value, i.e., |80°| or lower, are added to the toner of the invention as an externally-applied agent, scattering of the toner can be suppressed and scattering of fine powder can be further reduced in a toner having a low content of fine powder.

Next, the alternating impedance technique of the alumina fine particles will be described.

In usual, it is common that the electrical conductivity is quantitatively measured as a conductivity using a current/voltage meter. However, when measuring by placing a powder, such as alumina fine particles, as a sample between electrodes, (1) components derived from a particle bulk, (2) components derived from contact interface (grain boundary) between particles and particles, and (3) components derived from the resistance in the interface between the electrodes and the particle sample are considered as resistance components and the components cannot be distinguished by a direct current. Therefore, it has been proposed to measure the impedance of the particle bulk resistance using the alternating impedance technique using alternating current in place of direct current. However, in the invention, the phase angle (θ) for every alternating frequency obtained by the measurement by the alternating impedance technique is utilized as an index of the charge leak properties (conductivity) in the alumina fine particles in a state where an AC electric field has been applied.

In the alumina fine particles of the invention, the phase angle (θ) in an alternating frequency range of 1 kHz to 10 kHz measured by the alternating impedance method is |80°| or lower. However, when the phase angle (θ) exceeds |80°| to be close to |90°|, scattering from a development gap or fogging occurs, and thus such alumina fine particles are not preferable. The shift of the phase angle by |90°| represents that the movement of charges in the alumina fine particles cannot follow the changes in the alternating frequencies. When the phase angle (θ) is 0°, the movement of charges in the alumina fine particles can follow the changes in the alternating frequencies. It is considered that, in the alumina fine particles, the phase angle (θ) in an alternating frequency range of 1 kHz to 10 kHz is about |40°| at the smallest.

The reason for specifying the alternating frequency in the range of 1 kHz to 10 kHz range resides in that, in alternating components of a development electric field to be applied between a photoreceptor and a developing roller, when the gap is small in inverse proportion to the size of a gap between the photoreceptor and the developing roller, it is preferable to set the frequency to a low frequency and, in contrast, when the gap is large, it is preferable to set the frequency be to a high frequency. For example, when a toner having an average volume particle size as small as about 2 μm, it is preferable to set the gap to be small and to set the alternating frequency to about 10 kHz. In contrast, when a toner having an average volume particle size as large as about 12 μm, it is preferable to set the gap to be large and to set the alternating frequency to about 1 kHz.

The alumina particles are produced by various production methods. As the alumina fine particles having a phase angle (θ) in an alternating frequency range of 1 kHz to 10 kHz of |80°| or lower, one obtained by thermally decomposing ammonium dawsonite are mentioned. Examples include alumina fine particles obtained by production methods described in JP-A Nos. 63-100017, 58-26029, and 51-139810 in which the alumina purity is 99.99% or more, the BET specific surface area is 100 $m^2/g$ to 300 $m^2/g$, and the number average particle size is 5 nm to 20 nm. Examples of commercial alumina fine particles include TAIMICRON TM-100: $Al_2O_3$, manufactured by TAIMEI CHEMICALS Co., Ltd., in which a θ-alumina phase is the main phase, the primary particle size is 14 nm, and the BET specific surface area is 132 $m^2/g$ and TAIMICRON TM-300: $Al_2O_3$, manufactured by TAIMEI CHEMICALS Co., Ltd., in which the γ-alumina phase is the main phase, the primary particle size is 7 nm, and the BET specific surface area is 225 $m^2/g$.

The phase angle of the alumina fine particles (TAIMICRON TM-100 above) measured by the alternating impedance method continuously increases, e.g., about |65°| at 1 kHz, and then |79°| at 10 kHz. The phase angle of the alumina fine particles (TAIMICRON TM-300 above) continuously increases, e.g., about |43°| at 1 kHz, and then |70°| at 10 kHz.

Moreover, alumina fine particles produced according to the production method described in JP-A-2002-253953 and obtained by evaporating metal aluminum with a direct-current arc plasma, and oxidizing the vapor are mentioned. The alumina particles have an alumina purity of 99.9% or higher, a BET specific surface area of 20 $m^2/g$ to 80 $m^2/g$, and a number average particle size of 20 nm to 100 nm. Examples of a commercial item thereof include NanoTek $Al_2O_3$ manufactured by C.I. Kasei Co., Ltd., crystalline spherical fine particle having the γ-alumina phase as the main phase, a slight amount of α-alumina phase, and a primary particle size of 30 nm, and the BET specific surface area is 49.3 $m^2/g$.

The phase angle of commercial alumina fine particles (Nano.Tek) continuously decreases from 1 kHz to 10 kHz, e.g., about |58°| at 1 kHz, and then |48°| at 10 kHz. In the alumina fine particles having a phase angle (θ) in an alternating frequency range measured by the alternating impedance method of 1 kHz to 10 kHz of |80°| or lower, scattering from a development gas or fogging hardly occurs.

In contrast, the phase angle of alumina fine particles (C805, manufactured by Japan Aerosil Co., particle size of 13 nm) generally similarly referred to as conductive particles, the phase angle at 1 kHz is |86°| and the phase angle at 10 kHz is |88°|, which are close to approximately |90°|. The phase angle of Titania (STT30S, manufactured by Titan Kogyo, Ltd., particle size of 20 to 50 nm, BET specific surface area of 135 to 155 $m^2/g$) is |85°| at 1 kHz and |88°| at 10 kHz, which are close to approximately |90°|. In the alumina fine particles having a phase angle (θ) in an alternating frequency range measured by the alternating impedance method of 1 kHz to 10 kHz of more than |80°|, scattering from an unfavorable amount of development gap or fogging occurred.

The phase angle (θ) in the alternating impedance technique was measured using a dielectric measurement system (126096W, manufactured by Solartron, England) under the following conditions.

Sample holder for room temperature solid 12962A Sample shape Tablet of ϕ11 mm×1 mm (Pressing pressure of 2 t)

The sample is placed in the sample holder with both surfaces of the sample inserted between metal aluminum electrodes through a conductive paste.

Applied Voltage 0.1 V

Measurement frequency 1 mHz to 1 MHz

The alumina fine particles of the invention have effects of developing a charge leak action under an AC electric field and stabilizing the friction charge of a toner. Moreover, the alumina fine particles of the invention have effects of refreshing the photoreceptor surface by the polishing action of the alumina fine particles and stabilizing the chargeability of the photoreceptor. When the development device can supply a toner, toner supply fogging can be reduced or a residual memory caused by free externally-applied agents remaining on the photoreceptor can be reduced in a toner supply type development device in which a toner is newly supplied in addition to a residual toner. In contrast, when the development device cannot supply a toner, toner supply fogging can be reduced or a residual memory caused by free externally-applied agents remaining on the photoreceptor can be reduced in a use-up type development device in which a toner is newly charged in addition to a residual toner.

The alumina fine particles of the invention may be externally applied in a proportion of 0.2 part by mass to 5.0 parts by mass and preferably 0.5 part by mass to 2.0 parts by mass based on 100 parts by mass of toner base particles. When the treatment amount to the toner base particles is larger than the proportion mentioned above, there arise problems that the charge leak action excessively develops or free externally-applied agent generate. When the amount is smaller than the proportion mentioned above, desired polishing effects are not be obtained.

Next, an image forming device using the toner of the invention will be described.

Figure 3:
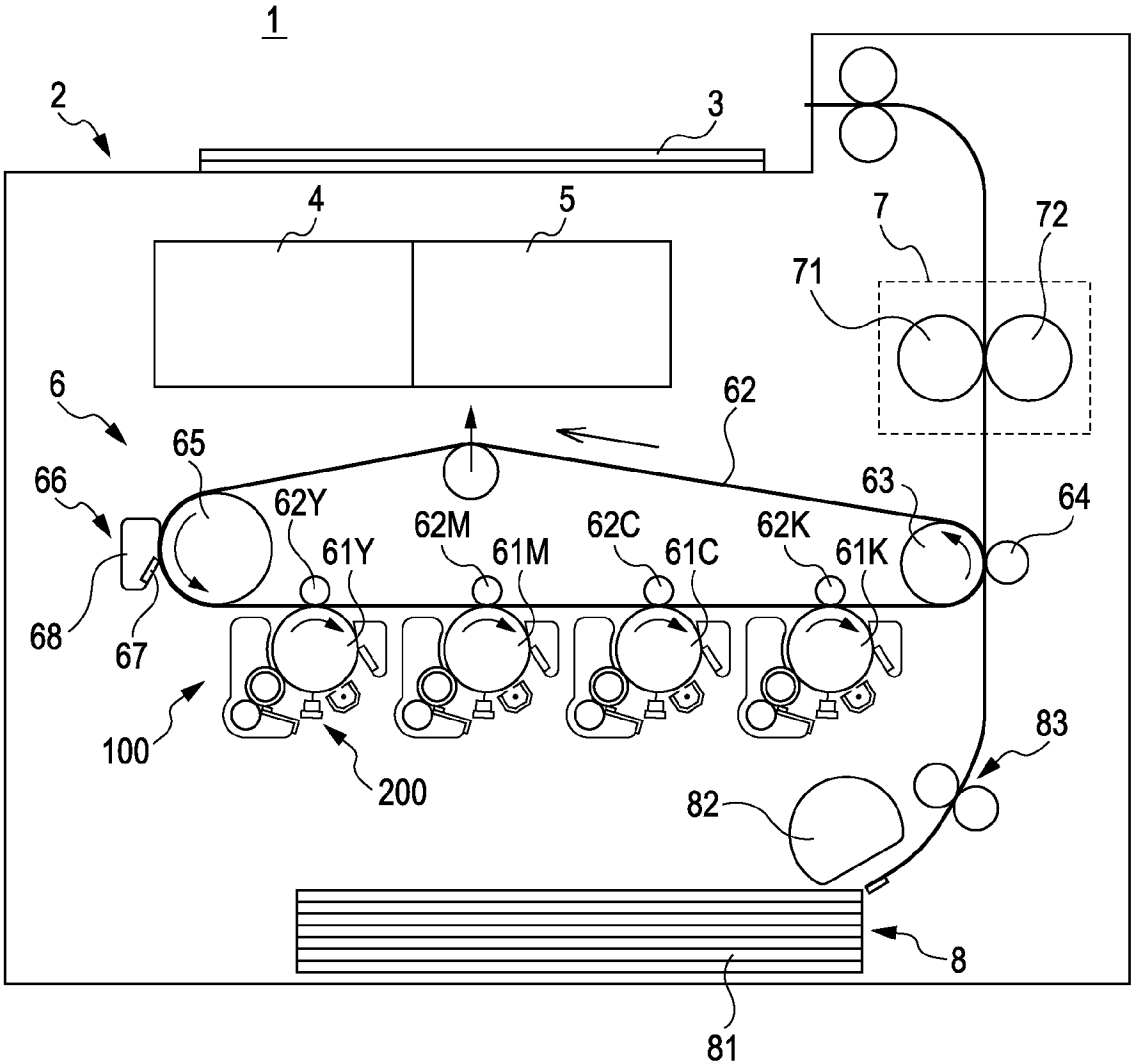
FIG. 3 is a view illustrating an example of an image forming device of the invention.

FIG. 3 is a view illustrating an example of an image forming device according to the invention.

An image formation device 1 is a device in which image formation sections are arranged in a tandem manner and has a housing 2 and a paper discharge tray 3 formed on an upper portion thereof. The housing 2 is provided with a power supply unit 4, a control unit 5, an image formation unit 6, a fixing unit 7, and a paper feed unit 8.

The image formation unit 6 has a plurality of (four in this embodiment) monochrome image formation units Y (for yellow), M (for magenta), C (for cyan), and K (for black) each forming a different color image. The monochrome image formation units Y, M, C, and K each have a photoreceptor 61 containing a photoreceptor on which an organic photosensitive layer or an inorganic photosensitive layer is formed and a development member 100 and an exposure member 200 disposed around the photoreceptor 61.

Photoreceptors 61Y, 61M, 61C, and 61K corresponding to the colors of the monochrome image formation units Y, M, C, and K each abut against a transfer belt 62 and transfer rollers 62Y, 62M, 62C, and 62K are disposed through the transfer belt. The transfer rollers each are electrically connected to a transfer voltage supply member which is not illustrated. By applying a transfer voltage to the transfer roller, a toner image formed on the surface of each photoreceptor 61 is successively primarily-transferred to the surface of the transfer belt 62 to form a color image.

The transfer belt 62 is circulated and driven in the direction shown by the arrow by a driving roller 63 and serves as a backup roller of for a transfer roller 64. On the circumferential surface of the driving roller 63, a rubber layer having a thickness of 3 mm and a volume resistivity of 1000 kΩ·cm or lower is formed. When the driving roller 63 is grounded through a metal axis, the driving roller 63 serves as a transfer voltage conductive path to be supplied through the transfer roller 64. Thus, by providing the rubber layer having high friction and impact absorption properties to the driving roller 63, the impact when recording media, such as paper and an OPC film, enters in the abutting portion of the driving roller 63 and the transfer roller 64 is hard to be transmitted to the transfer belt 62, and thus degradation of image quality can be prevented.

The transfer belt 62 is provided with a cleaner section 66 facing a tension roller 65. The cleaner section 66 has a waste toner collecting member 68 provided with a cleaner blade 67. When the top end of the cleaner blade 67 abuts against the tension roller 65 through the transfer belt 62, foreign substances, such as a toner and paper powder, remaining on the transfer belt after transfer are removed. Then, the foreign substances thus removed are collected by a waste toner collecting member 68.

The transfer roller 64 is removably formed relative to the transfer belt 62 and is driven by a transfer roller driving mechanism which is not illustrated.

The paper supply unit 8 has a paper feed section having a paper feed cassette 81 holding a plurality of papers while being laminated and a pickup roller 82 feeding papers one by one from the paper feed cassette 81. Papers are fed from the paper feed section by the pickup roller 82, the paper feed timing is adjusted in the roller pair 83, and then papers are fed to the transfer roller 64 and secondarily transferred. In the invention, fed paper, paper, etc., refer to recording medium capable forming images including not only paper but OPC film and the like.

The fixing unit 7 has a heating roller 71 has a heating element, such as a halogen heater, and can freely rotate and a backup roller 72 disposed facing the heating roller 71, by which transferred toner images are thermally fixed as images at a given temperature.

The paper subjected to fixing processing is conveyed to the paper discharge tray 3 disposed on an upper surface portion of the housing 2.

In the description above, an example in which the image formation sections are arranged in a tandem manner, but an image forming device in which development units of four colors are disposed around one photoreceptor and images are successively developed may be acceptable.

Figure 4A:
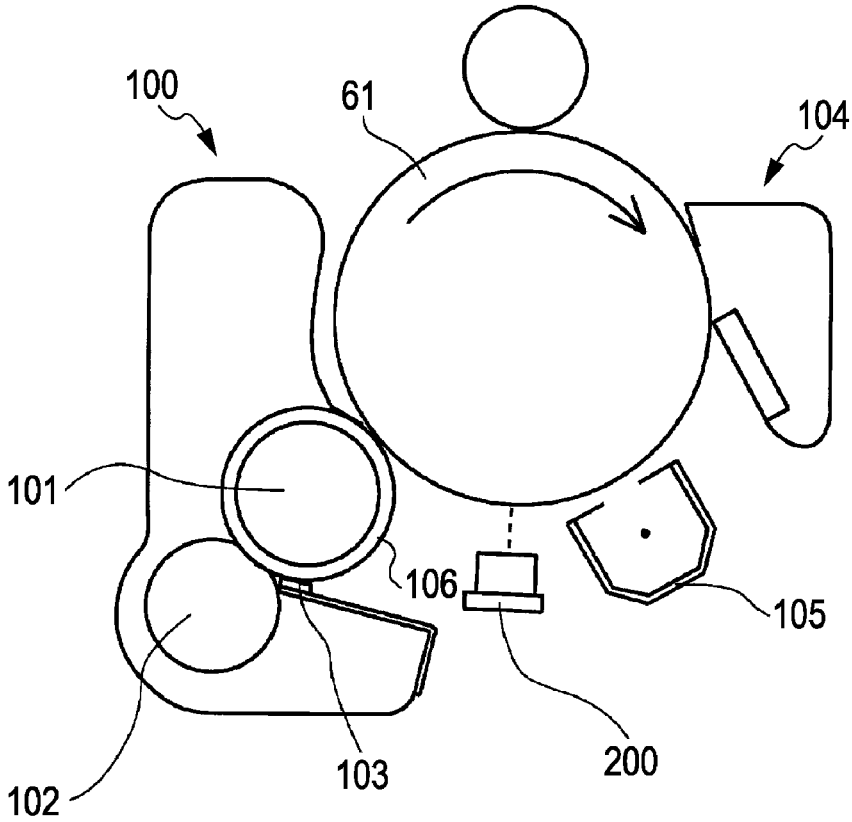
FIG. 4A is a view illustrating an image formation mechanism of the invention.
Figure 4B:
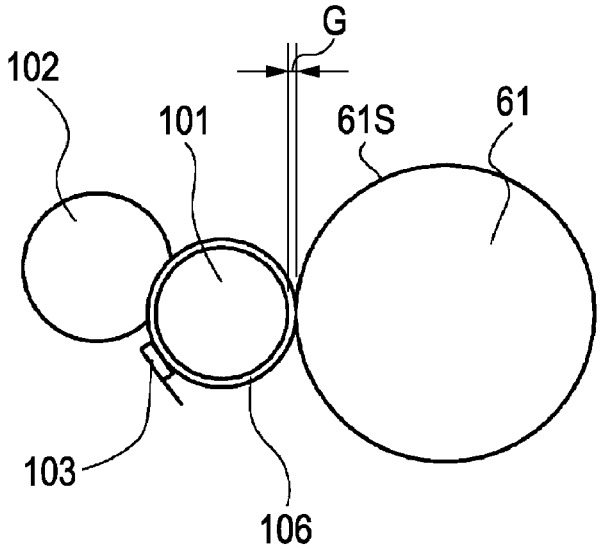
FIG. 4B is a view illustrating an image formation mechanism of the invention.
Figure 5A:
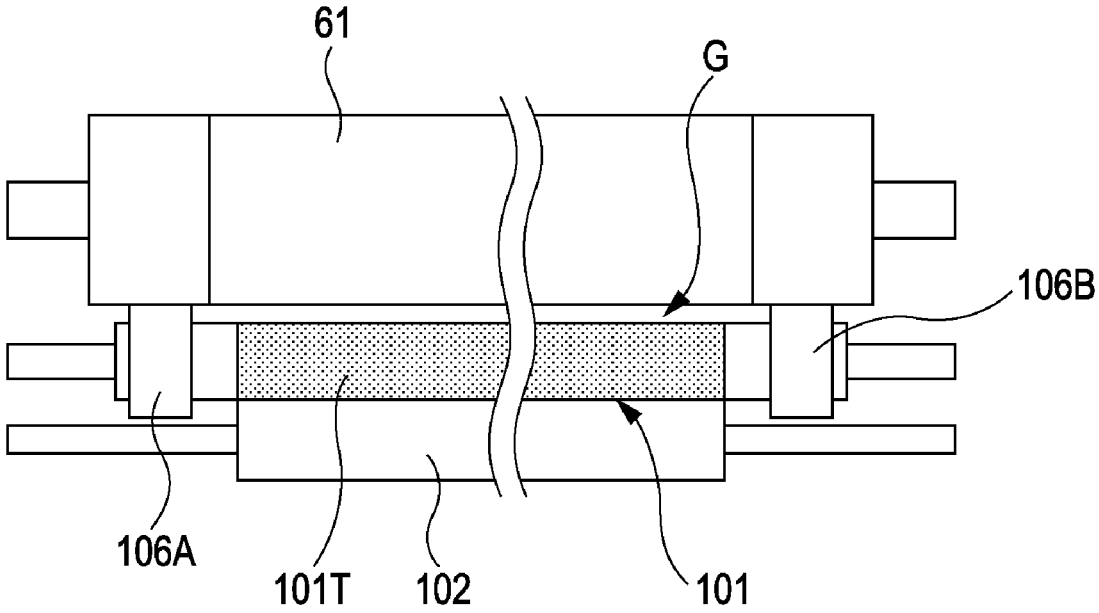
FIG. 5A is a view illustrating a development member of the invention.
Figure 5B:
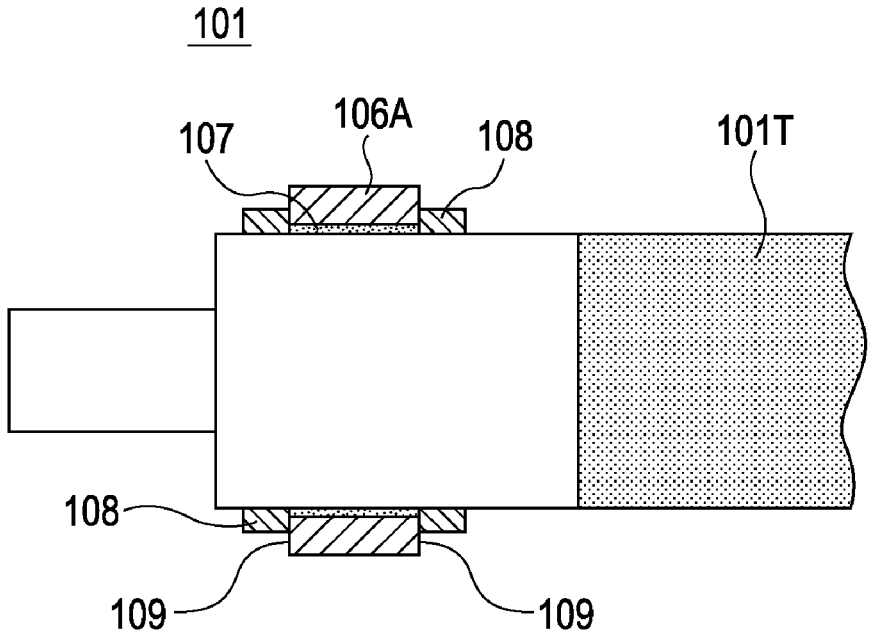
FIG. 5B is a view illustrating a development member of the invention.

FIG. 4 is a view illustrating an image formation mechanism of the invention. FIG. 4(A) is an enlarged view of the image formation unit illustrated in FIG. 2. FIG. 4(B) is a view illustrating a development process. FIG. 5 is a view illustrating a development member of the invention. FIG. 5 (A) is a side view thereof. FIG. 5(B) is a cross sectional view in which one end of a development roll is enlarged.

The image formation unit 6 has the photoreceptor 61 and the development member 100 disposed around the photoreceptor 61.

The development member 100 has a development roller 101 for conveying a toner to the photoreceptor 61, a supply roller 102 which is pressed against the development roller 101 and supply a toner, a regulation blade 103 which is pressed against the development roller 101 and regulates the toner to be conveyed to the photoreceptor 61, and a toner collecting member 104 for collecting a toner remaining on the photoreceptor 61 after primary transfer. The development member 100 further has a charge member 105 and a line head type exposure member 200 in close vicinity to the photoreceptor 61.

The development member 100 has the development roller 101 for conveying a toner to the photoreceptor 61 and the supply roller 102 which is pressed against the development roller 101 and conveys a toner. At a portion except a toner conveying section 101T at the central portion of the development roller 101, spacers 106A and 106B that are concentric with the development roller 101 and have a uniform thickness are formed. When the surface of the spacers 106A and 106B abuts against the photoreceptor 61 and rotates, a given development gap G is formed.

The development gap G is adjusted to a desired size by selecting the thickness of the spacers 106A and 106B as appropriate. It is structured that the photoreceptor 61 clockwise rotates and the development roller 101 and the supply roller 6 counterclockwise rotate. The circumferential speed of the photoreceptor 61 and the circumferential speed of the spacers 106A and 106B on the development roller 101 are set to be the same or substantially the same circumferential speed. Thus, a non-contact jumping development of a non-magnetic one-component developer using a toner which is a non-magnetic one-component developer can be achieved.

For the development roller 101, members having low stress shrinkage or low thermal shrinkage, such as rollers of metals of iron or the like or resin, such as urethane, are used. In contrast, for the spacers 106A and 106B disposed on the development roller 101, it is preferable to use substances that have elasticity and hygroscopicity higher than that of the development roller 101, swells when the humidity becomes high to increase the volume to increase the interval between the development roll and the photoreceptor, i.e., a development gap and, even when the humidity becomes high, discharge is hard to occur and the same charge development can be performed.

Specifically, substances that allow the use of polyamide, polyamide imide, acetate, acrylate, rubber, etc., having high absorption and that have low conductivity are preferable. Furthermore, when joined with a non-water absorptive and insulating adhesive, such as an acrylic adhesive or a silicone adhesive, insulation is held even when moisture is absorbed. Thus, joining with such adhesives is preferable.

With respect to the spacers 106A and 106B, as shown in a cross sectional view of FIG. 5(B), a portion of the spacer 106A can be fixed to the surface of portions other than the toner conveying portions of both the ends of the development roller 101 with an adhesive layer 107 having elasticity. In addition to the adhesive layer, the spacers may be fixed utilizing thermal shrinkage of spacer materials.

The dimensional changes caused by swelling due to moisture absorption of the spacers 106A and 106B preferably occurs in such a manner that the dimensional change in the direction perpendicular to the axis of the development roller, i.e., thickness direction, becomes larger than the dimensional change in the horizontal direction, i.e., the axis direction and the circumferential direction.

In order to achieve the above, as illustrated in FIG. 5(B), it is preferable to dispose, at the development roller 101, a horizontal dimensional change inhibition section 108 along a side surface 109 in the axis direction of the development roller of the spacer 106A so as to suppress dimensional changes in the horizontal direction due to swelling of the spacer 106A and to achieve dimensional changes due to swelling in the vertical direction, i.e., the thickness direction. As the horizontal dimensional change inhibition section 108, materials that hardly suffer from dimensional changes due to moisture absorption compared with the materials for the spacers can be used.

It is preferable to dispose the horizontal dimensional change inhibition section at each of the spacers disposed at both the ends of the development roller.

According to the image forming device using such a development member 100, materials having higher hygroscopicity than that of the development roller 101 are used for the spacers 106A and 106B to be fixed to the development roller 101. Thus, when the image forming device is used in a high humidity environment, the hygroscopic spacers 106A and 106B absorb moisture and swell to increase the development gap G. Thus, even in a high humidity environment, a reduction in firing potential between the development roller and the photoreceptor can be prevented. Therefore, also when the image forming device is used under a high temperature and high humidity environment, a relatively high development voltage can be applied and image quality can be increased. In particular, the application of a high development voltage is very effective for image formation using a small-particle-size toner.

By fixing the spacers 106A and 106B to the development roller 101 with the adhesive layer 107 having elasticity, even when the spacers 106A and 106B swell in a high humidity environment, the spacers do not separate from the development roller 101 and the development gap G becomes large and thus non-contact development effects can be more certainly demonstrated.

By setting the dimensional changes caused in the vertical direction by swelling due to moisture absorption of the spacers 106A and 106B, i.e., dimensional changes in the thickness direction, to be larger than dimensional changes in the horizontal direction, i.e., dimensional changes in the axis direction and the circumferential direction, the changes in the development gap G due to swelling of the spacers 106A and 106B can be effectively enlarged even at the same volume expansion coefficient. By suppressing the horizontal dimensional changes in which wrinkles are likely to generate in the spacers 106A and 106B, the generation of wrinkles in the spacers 106A and 106B can be suppressed. In particular, by providing the horizontal dimensional change inhibition section 108, the dimensional changes in the axis direction of the spacers 106A and 106B caused by swelling can be suppressed and the changes in the dimension in the thickness direction can be increased. Thus, the changes in the development gap G as described above can be more effectively increased and the generation of wrinkles in the spacers 106A and 106B can be more effectively suppressed.

As in the invention, when high-resolution image formation is performed using a toner having a number mode diameter of 3 μm or more and 6 μm or lower and a 2.5 μm number frequency of 5% or lower, it is preferable to hold a high-accuracy development gap and apply a development voltage on which an alternating current is superimposed for development.

It is preferable to adjust the development gap to 20 to 70 μm and, as the development voltage, it is preferable to superimpose a rectangular wave alternating current of 800 V to 1400 V having a frequency of 4000 to 8000 Hz on a direct current voltage of 100 to 400 V.

As described above, high resolution image development can be achieved by the use of a high-accuracy development gap by the spacers and a toner having a number mode diameter of 3 μm or more and 6 μm or lower.

Hereinafter, the invention will be described with reference to Examples and Comparative Examples.

EXAMPLES

Example 1

Production of Toner

Synthesis of Crosslinked Polyester Resin for Binder Resin

Raw materials, such as acids, alcohol components, and catalysts in the following composition, were charged in a 50 L reaction pot, and reacted at 240° C. under a normal pressure and a nitrogen air current for 12 hours. Thereafter, the pressure was gradually reduced, and the reaction was continued at $1.33\times10^3$ Pa. The reaction was pursued by the softening point based on ASTM E28-517. When the softening point reached 160° C., the reaction was terminated.

| | |
|---|---|
| Terephthalic acid | 3.9 parts by mass |
| Isophthalic acid | 9.06 parts by mass |
| Ethylene glycol | 2.54 parts by mass |
| Neopentylglycol | 4.26 parts by mass |
| Tetrabutyl titanate | 0.1 part by mass |
| Epiclon 830 (Bisphenol F type epoxy resin, manufactured by Dainippon Ink and Chemicals Ltd., Epoxy equivalent of 170 (g/eq)) | 0.3 part by mass |
| Cardula E (Alkyl glycidyl ester, manufactured by Shell Japan), Epoxy equivalent of 250 (g/eq) | 0.1 part by mass |

The obtained polymer was a colorless solid and had an acid value of 11.0, a glass transition temperature (Tg) of 60° C., and a softening point (T1/2) of 178° C.

The weight average molecular weight measured with a GPC measurement device (HLC-8120GPC, manufactured by Tosoh Corporation) using, in combination, TSK-GEL G5000 HXL.G4000 HXL.G3000 HXL.G2000HXL, manufactured by Tosoh Corporation as a separation column under the conditions of a column temperature: 40° C., a solvent: tetrahydrofuran, a solvent concentration: 0.5% by mass, a filter: 0.2 μm, and a flow rate: 1 ml/min was 250000 in terms of standard polystyrene. Synthesis of binder resin (linear polyester resin)

Raw materials, such as acids, alcohol components, and catalysts in the following composition, were charged in a 50 L reaction pot, and reacted at 210° C. under a normal pressure and a nitrogen air current for 12 hours. Thereafter, the pressure was gradually reduced, and the reaction was continued at $1.33\times10^3$ Pa. The reaction was pursued by the softening point based on ASTM E28-517. When the softening point reached 87° C., the reaction was terminated.

| | |
|---|---|
| Terephthalic acid | 5.31 parts by mass |
| Isophthalic acid | 7.97 parts by mass |
| Ethylene glycol | 2.6 parts by mass |
| Neopentylglycol | 4.37 parts by mass |
| Tetrabutyl titanate | 0.1 part by mass |

The obtained polymer, i.e., a liner polyester resin, was a colorless solid and had an acid value of 10.0, a glass transition temperature (Tg) of 46° C., and a softening point (T1/2) of 95° C.

The weight average molecular weight of the obtained linear polyester resin measured in the same manner as above was 5200.

Preparation of Wax Master Dispersion 30 parts by mass of carnauba wax (manufactured by Toakasei Co., Ltd.), 70 parts by mass of the linear polyester resin previously produced, and 150 parts by mass of methyl ethyl ketone were preliminarily mixed in a Desper, and then the mixture was pulverized by a Star Mill LMZ-10 (manufactured by Ashizawa Finetech Ltd.), thereby preparing a wax master dispersion 1 having a solid content of 40% by mass. The composition is Linear polyester resin/Wax/Methyl ethyl ketone=28/12/60.

Preparation of Coloring Agent Master Chip 2000 parts by mass of cyan pigment (Cyan pigment manufactured by Dainippon Ink & Chemicals, Inc.: Ket Blue 111, C.I. Pigment B-15:3) and 2000 parts by mass of linear polyester resin were put in a 20 L Henschel mixer (manufactured by Mitsui Mining & Smelting Co., Ltd.) provided with an ST/AO stirring blade, and stirred for 2 minutes at 698 $min^{-1}$, thereby obtaining a mixture. The mixture was melted and kneaded using an open roll continuous extrusion kneader (KNEADEX MOS140-800 manufactured by Mitsui Mining & Smelting Co., Ltd.), thereby preparing a coloring agent master chip.

The obtained master chip was diluted with the linear polyester resin and methyl ethyl ketone, and then the fine dispersion state of the coloring agent and the presence of coarse particles were observed under a 400× optical microscope. Thus, no coarse particles were observed and the coloring agent was uniformly fine-dispersed. The composition of the master chip was Coloring agent/Resin=50/50 in the mass ratio.

Coloring Resin Solution Preparing Process 10.8 parts by mass of the wax master dispersion liquid, 10.4 parts by mass of the coloring agent master chip, 12 parts by mass of the crosslinked polyester resin, 10 parts by mass of the linear polyester resin, and 8.65 parts by mass of methyl ethyl ketone were added, mixed at a stirring rate of 777 $min^{-1}$ with a stirrer (Desper manufactured by Asada Iron Works Co., Ltd., blade diameter of 230 mm) for 2 hours while maintaining a temperature at 40 to 45° C., and dissolved and dispersed.

Emulsification Process 46.37 parts by mass (solid content of 30 parts by mass) of the coloring resin solution was charged in a 2 $m^3$ cylindrical reactor provided with a stirrer (Desper manufactured by Asada Iron Works Co., Ltd.) so that the solid content was 200 kg, and subsequently 5 parts by mass of 1-normal ammonia water was added as a basic compound. Then, the mixture was sufficiently stirred at 777 $min^{-1}$, and then the temperature was adjusted to 35° C.

Subsequently, the stirring rate was changed to 1100 $min^{-1}$, and then 37.25 parts by mass of water was added dropwise at a rate of 1.0 part by mass/min. The circumferential speed of the stirring blade at this time was 13.2 m/s. With the addition of water, the viscosity of the system increased. However, water was taken into the system simultaneously with dropping, and thus stirring and mixture was uniformly performed.

The phase inversion point at which the viscosity sharply decreases when 26 parts by mass of water was added was observed. After adding water, the slurry was observed under an optical microscope. Thus, it was observed that the resin dissolved and the coloring agent dispersion and the wax dispersion were dispersed but non-emulsified substances were not observed. Based on the fact that the coloring agent dispersion and the wax dispersion were stably dispersed in an aqueous medium, it is considered that the resin adsorbs to the dispersion surface. In this case, the state in the system was uniform and the generation of coarse particles by the addition was not observed.

Unifying Process

The emulsified suspension obtained in the emulsification process was transported to a 2 $m^3$ reactor provided with a Maxblend blade (registered trademark), and then the temperature was adjusted to 25° C. while maintaining the stirring rate at 85 $min^{-1}$. Thereafter, the stirring rate was increased to 120 $min^{-1}$, and 12 parts by mass of a 3.5% by mass aqueous sodium sulfate solution was added dropwise as an aqueous electrolyte solution at a rate of 1 kg/min. 5 minutes after the termination of the dropwise addition, the stirring rate was reduced to 85 $min^{-1}$, and then stirring was performed for 5 minutes. Thereafter, the stirring rate was reduced to 65 $min^{-1}$, and then stirring was performed.

When the unification proceeded to reach 3 μm, the stirring rate was increased to 120 $min^{-1}$, the stirring was continued for 30 minutes, 0.1 $m^3$ of water was added dropwise, and the unification was stopped, thereby obtaining a unified liquid.

Separation Process 0.3 $m^3$ of the unified liquid obtained in the previous process was supplied while rotating a basket type centrifuge (T-36 manufactured by Tanabewilltec) provided with a non-porous basket at 600 G, and then centrifuged for 10 minutes. Thereafter, the dispersion liquid was removed, and then the particles adhering in the shape of a cake were scratched. The scratched particles were stirred and mixed with 0.2 $m^3$ of water, and then centrifuged again in the same manner as in the centrifuging process described above. The centrifuging operation was repeated 4 times.

Drying Process

The obtained cake-shaped particles were dried for 48 hours in a vacuum stirring container maintained at 30° C. The particles somewhat shrinked due to drying, and the number mode diameter of the obtained particles was 3.01 μm.

Externally-Applying Process

To 100 g of the obtained particles as toner base particles, 2 parts by mass of negatively charged silica particles RX200 (manufactured by Japan Aerosil Co., Average particle size of 12 nm, hexamethyldisilazane treatment), 1.5 parts by mass of negatively charged silica particles RX50 (manufactured by Japan Aerosil Co., Average particle size of 40 nm, hexamethyldisilazane treatment), and 0.5 part by mass of alumina fine particles (TAIMICRON TM-300: $Al_2O_3$, manufactured by TAIMEI CHEMICALS Co., Ltd., in which the γ-alumina phase is the main phase, the primary particle size is 7 nm, and the BET specific surface area is 225 $m^2/g$) were added, and stirred for 3 minutes at 10000 $min^{-1}$ (equivalent to the circumferential speed of the blade of about 30 m/sec) with a 1 L stirrer of Waring blender 7012S manufactured by Waring, thereby producing a toner 1.

Measurement of Toner Particle Size Distribution

The particle size distribution of the obtained toner was measured with a particle image analyzer (Flow particle image analyzer, FPIA-1000 manufactured by SYSMEX CORPORATION). The measurement range was set to 0.6 μm to 400 μm, the number mode diameter which is the peak of the number frequency distribution was determined, and the number frequency and the volume frequency of 2.5 μm or lower were determined.

Measurement of Fine Particles Released from Image Formation Device

A test toner was charged in a toner cartridge of a Laser printer (LPS6500 manufactured by Seiko Epson Corporation), and printing was performed. With respect to the printing conditions, the bias was adjusted so that the color density OD value on the paper was 1.4.

The measurement was performed by continuously printing 400 sheets (10 minutes) in a 2 $m^2$ wide chamber in which ventilation was performed 4 times using a given standard pattern RAL_UZ122/RALA00.PDF having a given printing area of 5% based on "Test method for the determination of emissions from hard copy devices with respect to awarding the environmental label for office printers with printing functions" according to RAL-UZ 122 established in Bundesanstalt für Materialforschung und-prüfung specified in General award conditions of the German Environmental Label, "Office Equipment with Printing Function (Printers, Copiers, Multifunction Devices)".

The measurement of PM2.5 was determined by measuring the particle size distribution under continuous printing with a ultrafine particle counter (8220 manufactured by TSI), and integrating the mass of particles of 2.5 μm or lower while defining the specific gravity as 1.

The obtained results are shown in Table 1.

Example 2

In the unification process, when the unification proceeded to reach 4 μm, the stirring rate was increased to 120 $min^{-1}$, the stirring was continued for 30 minutes, 0.1 $m^3$ of water was added dropwise, and then the unification was stopped.

Thereafter, classification and drying were performed in the same manner as in Example 1, and thereafter an evaluation test was performed in the same manner as in Example 1. The results are shown in Table 1.

Example 3

A toner was prepared in the same manner as in Example 2, except that, after classifying and drying, 0.2% by mass of silicone oil (KF-96-200CS manufactured by Shin-Etsu Chemical Co., Ltd., 100% dimethyl polysiloxane) having a kinetic viscosity at 25° C. of 200 $mm^2/s$ was added and an evaluation test was performed in the same manner as in Example 1. The results are shown in Table 1.

Example 4

In the unifying process, when the unification proceeded to reach 4.5 μm, the stirring rate was increased to 120 $min^{-1}$, the stirring was continued for 30 minutes, 0.1 $m^3$ of water was added dropwise, and then the unification was stopped.

Thereafter, classification and drying were performed in the same manner as in Example 1, and thereafter an evaluation test was performed in the same manner as in Example 1. The results are shown in Table 1.

Comparative Examples 1 to 3

Toners were prepared in the same manner as in Example 1, except changing the centrifuge force and the centrifuge time in the classifying process to the conditions shown in Table 1. The properties of the toners were evaluated in the same manner as in Example 1. The results are shown in Table 1.

Example 5

Preparation of Resin Particle Dispersion Liquid 1

30 parts by mass of styrene, 10 parts by mass of n-butyl acrylate, 1.3 parts by mass of β-carboethyl acrylate, 0.4 part by mass of dodecanethiol, 17.5 parts by mass of water, and 0.35 part by mass of an anionic surfactant (alkyldiphenyloxyoxidedisulfonate DOWFAX2A1) were stirred in a first container, thereby preparing an emulsion.

In contrast, 17.5 parts by mass of water, 0.35 part by mass of an anionic surfactant (alkyldiphenyloxyoxidedisulfonate DOWFAX2A1), and 0.4 part by mass of ammonium persulfate were put in a second container, the container was heated while replacing the inside of the container with nitrogen, and the temperature was held at 75° C.

Subsequently, the emulsion in the first container was added dropwise over 3 hours to the second container, and emulsion polymerization was performed. After the termination of the dropwise addition, the reaction was continued for 3 hours while holding the temperature at 75° C., thereby obtaining a resin particle dispersion liquid 1.

Preparation of Coloring Agent Dispersion Liquid 1

20 parts by mass of carbon black (Mogal L manufactured by Cabot) and 2 parts by mass of an anionic surfactant (NEOGEN R manufactured by DAI-ICHI KOGYO SEIYAKU Co., Ltd.) were mixed using a homogenizer for 10 minutes, thereby obtaining a black coloring agent dispersion liquid 1 having a cumulative number average particle size D50n of 250 nm.

Preparation of Wax Dispersion Liquid 30 parts by mass of paraffin wax (HNP0190 manufactured by NIPPON SEIRO, Melting point of 85° C.), 3 parts by mass of a cationic surfactant (Sanisol B50 manufactured by Kao Corporation), and 67 parts by mass of water were mixed and dispersed at 95° C. by a homogenizer, and dispersed using a pressure-jet type homogenizer (Gaulin homogenizer manufactured by Gaulin), thereby obtaining a mold release agent dispersion liquid having a cumulative number average particle diameter D50n of mold release agent particles of 300 nm, a melting point of 85° C., a melt viscosity at 150° C. of 1 Pa·s.

Preparation of Toner 54.8 parts by mass of the resin particle dispersion liquid 1, 8 parts by mass of the coloring agent dispersion liquid, 12 parts by mass of the mold release agent dispersion liquid, and 0.2 part by mass of polyaluminum chloride were put in a reactor, and mixed and dispersed by a homogenizer. Thereafter, the reactor was heated to 48° C. while stirring the inside of the reactor in an oil bath and held for 30 minutes. Then, the temperature of the oil bath was further increased to 50° C., and held at the temperature for 1 hour. Thus, aggregated particles were obtained. Subsequently, 25 parts by mass of the resin particle dispersion liquid 1 were further added so as to cover the surface of the obtained aggregated particles, and then stirred.

Thereafter, a 0.5 normal aqueous sodium hydroxide solution was added, the pH was adjusted in a neutral range, heated to 95° C. while stirring, held at the temperature for 5 hours, and heated and fused, thereby producing a toner.

After the completion, the reactor was cooled, and sufficiently washed with water. Then, solid-liquid separation was performed by Nutsche suction filtration. Next, the resultant was re-dispersed in 3 L of 40° C. water, and washed while stirring for 15 minutes. The washing operation was repeated 4 times, solid-liquid separation was performed by Nutsche suction filtration, and then dried for 12 hours under a vacuum, thereby preparing a toner. The obtained toner was examined in the same manner as in Example 1 and the results are shown in Table 1.

Comparative Example 4

An examination was performed in the same manner as in Example 1 by charging a toner for LP-S500 Printer manufactured by Seiko Epson Corporation carrying a toner obtained by an emulsion polymerization method in a toner cartridge for Laser printer LPS 6500 manufactured by Seiko Epson Corporation, and the results are shown in Table 1.

Comparative Example 5

The printer LP-56500 manufactured by Seiko Epson Corporation was examined in the same manner as in Example 1, and the results are shown in Table 1.

Comparative Example 6

To a toner for the printer LP-56500 manufactured by Seiko Epson Corporation, 0.2% by mass of silicone oil (KF-96-200CS manufactured by Shin-Etsu Chemical, 100% dimethyl polysiloxane) having a kinetic viscosity at 25° C. of 200 $mm^2/s$ was added, and an evaluation test was performed in the same manner as in Example 1. Results are shown in Table 1.

TABLE 1

| | Toner | Classification and external application | Number mode diameter [μm] | Number frequency of number mode diameter or lower [%] | Number frequency of 2.5 μm or lower [%] | Volume frequency of 2.5 μm or lower [%] | PM2.5 measurement value [μg/m3] |
|---|---|---|---|---|---|---|---|
| Ex. 1 | Toner obtained by phase inversion emulsification method | Classification of present invention | 3.01 | 49 | 8 | 3.2 | 2 |
| Ex. 2 | Toner obtained by phase inversion emulsification method | Classification of present invention | 3.89 | 47 | 3 | 0.36 | 0.9 |
| Ex. 3 | Toner obtained by phase inversion emulsification method | Classification of present invention + External application of silicone oil | 3.96 | 45 | 2 | 0.18 | 0.4 |
| Ex. 4 | Toner obtained by phase inversion emulsification method | Classification of present invention | 4.45 | 47 | 3 | 0.35 | 0.8 |
| Ex. 5 | Toner obtained by emulsion polymerization method | Classification of present invention | 5.90 | 48 | 8 | 0.10 | 2 |
| Comp. Ex. 1 | Toner obtained by phase inversion emulsification method | Classification of present invention | 2.79 | 64 | 18 | 7.2 | 13 |
| Comp. Ex. 2 | Toner obtained by phase inversion emulsification method | | 3.81 | 54 | 9 | 0.53 | 3 |
| Comp. Ex. 3 | Toner obtained by phase inversion emulsification method | Classification of present invention | 6.53 | 53 | 4 | 0.38 | 3 |
| Comp. Ex. 4 | Toner B obtained by emulsion polymerization method | | 5.04 | 53 | 14 | 0.11 | 9 |
| Comp. Ex. 5 | Pulverized toner D | | 8.46 | 59 | 29 | 0.08 | 8 |
| Comp. Ex. 6 | Pulverized toner F | External application of silicone oil | 10.05 | 77 | 23 | 0.06 | 3 |

Example 6

A toner was produced in the same manner as in Example 2, except changing the classification by a centrifuge, the centrifuge force applied during dehydration, and the centrifuge time and the cake-like particles obtained by the centrifuge were dispersed in water and the operation of classification and dehydration by a centrifuge was repeated three times. Then, the number frequency of the obtained toner equal to or lower than the number mode diameter or lower was measured.

As a result, when the centrifuge force was 500 G to 900 G and the centrifuge time was 5 to 30 minutes, the number frequency of the toner equal to or lower than the number mode diameter or lower is 50% or lower, and it was confirmed that the classification was sharply performed.

TABLE 2

| | Centrifuge force [G] | Centrifuge time [min] | Number frequency of number mode diameter or lower [%] |
|---|---|---|---|
| Ex. 6 | 500 | 5 | 49 |
| Ex. 7 | 600 | 10 | 47 |
| Ex. 8 | 600 | 20 | 47 |
| Ex. 9 | 900 | 30 | 49 |
| Comp. Ex. 7 | 400 | 10 | 54 |
| Comp. Ex. 8 | 600 | 3 | 54 |
| Comp. Ex. 9 | 900 | 40 | 52 |
| Comp. Ex. 10 | 1000 | 10 | 54 |

As in the invention, since the toner was centrifuged by a centrifuge having a non-porous cylindrical tank, a particle layer was deposited on the wall surface of the cylindrical tank, a residual dispersion liquid was removed, and the particle layer deposited in the shape of a cake was collected, the precipitation of fine particles with particles to form a cake, which has occurred in a porous centrifuge or solid-liquid separation by filtration, is prevented, and fine powder particles are made to remain in a dispersion liquid, and particles substantially not containing fine powder of 2.5 μm or lower can be obtained.

Moreover, as in the invention, in a toner having a number mode diameter of 3 to 6 μm, the classification effects are the highest. More specifically, in a toner having a number mode diameter larger than 6 μm, even when particles of 2.5 μm or lower whose frequency is low are classified, the classifying effects sharply decrease and when a toner of 3 μm or lower is classified in terms of 2.5 μm, the yield decreases, and thus the toner is not industrially practical. When the toner excessively remains in a dispersion liquid, the classification accuracy decreases and the sharpness of the classification also decreases. Therefore, when the number mode diameter is 3 μm or more and 6 μm or lower, the classification can be most sharply carried out.

The particle size of the toner of the invention was much smaller than 25 $\mu g/m^3$ which is a guideline value of WHO for PM2.5. As described above, the invention can provide a toner and an image forming device that can satisfy the regulation of PM2.5.

What is claimed is:

1. A toner, having a number mode diameter of 3 μm or more and 6 μm or lower and a particle size distribution of a toner including an externally-applied agent in a range of 0.6 μm to 400 μm in which the number frequency of a toner including the externally-applied agent smaller than the number mode diameter is smaller than the number frequency of a toner equal to or larger than the number mode diameter.

2. The toner according to claim 1, wherein the toner passes through a process for classifying fine particles in liquid and has a number frequency of 2.5 μm or lower of 5% or lower.

3. The toner according to claim 1, comprising 0.05 to 2 parts by mass of silicone oil based on 100 parts by mass of colored resin particles.

4. The toner according to claim 1, comprising, as the externally-applied agent, alumina fine particles having a phase angle (θ) in an alternating frequency range of 1 kHz to 10 kHz measured by an alternating impedance method of |80°| or lower.

5. A toner production method, comprising:

pouring a dispersion liquid in which colored resin particles are dispersed in an aqueous medium in a centrifuge having a nonporous cylindrical tank on the inner wall surface having a rotation axis in the perpendicular direction and rotating the centrifuge, discharging the dispersion liquid in the cylindrical tank after particle components adhere to the inner wall surface of the cylindrical tank by centrifuge force, and separating the colored resin particles adhering to the inner wall surface, thereby obtaining a toner having a number mode diameter of 3 μm or more and 6 μm or lower and a particle size distribution of a toner including an externally-applied agent in the range of 0.6 μm to 400 μm in which the number frequency of a toner including the externally-applied agent smaller than the number mode diameter is smaller than the number frequency of a toner equal to or larger than the number mode diameter.

6. The toner production method according to claim 5, wherein the centrifuge force is 500 to 900 G and the rotation time is 5 to 30 minutes.

7. The toner production method according to claim 5, wherein separating the dispersion liquid of the cylindrical tank, dispersing colored resin particles adhering to the inner wall surface in an aqueous medium, pouring the same in the centrifuge, and repeating the process of claim 5.

8. The toner production method according to claim 6, wherein separating the dispersion liquid of the cylindrical tank, dispersing colored resin particles adhering to the inner wall surface in an aqueous medium, pouring the same in the centrifuge, and repeating the process of claim 6.

9. The toner production method according to claim 5, wherein the centrifuge force is 500 to 900 G and the rotation time is 5 to 30 minutes.

10. The toner production method according to claim 5, wherein the colored resin particles are produced by unifying particles deposited by emulsifying a composition at least containing a synthetic resin, a coloring agent, and a wax in an aqueous medium by adding an electrolyte.

11. An image forming device, comprising:

a photoreceptor supporting an electrostatic latent image; and a development device that is disposed facing the photoreceptor in a non-contact state with the photoreceptor and that develops the electrostatic latent image on the photoreceptor by jumping development of adhering a toner to the electrostatic latent image on an electrostatic latent image support by flying the toner between a development member and the electrostatic latent image support that are held in a non-contact state using a toner obtained by pouring a dispersion liquid in which colored resin particles are dispersed in an aqueous medium in a centrifuge having a non-porous cylindrical tank on the inner wall surface having a rotation axis in the perpendicular direction and rotating the centrifuge, stopping the rotation of the cylindrical tank after particle components adhere to the inner wall surface of the cylindrical tank by centrifuge force, classifying the particles by discharging the dispersion liquid in which the proportion of particles having a small particle size in the cylindrical tank increases, and then drying the colored resin particles adhering to the inner wall surface of the cylindrical tank and having a number mode diameter of 3 μm or more and 6 μm or lower and a particle size distribution of a toner including an externally-applied agent in the range of 0.6 μm to 400 μm in which the number frequency of a toner including the externally-applied agent smaller than the number mode diameter is smaller than the number frequency of a toner equal to or larger than the number mode diameter.

* * * * *